US010023986B2

(12) United States Patent
Kawaguchi et al.

(10) Patent No.: US 10,023,986 B2
(45) Date of Patent: Jul. 17, 2018

(54) WASHING MACHINE

(71) Applicants: HAIER ASIA INTERNATIONAL CO., LTD., Osaka (JP); QINGDAO HAIER WASHING MACHINE CO., LTD., Shandong (CN)

(72) Inventors: Tomonari Kawaguchi, Osaka (JP); Katsuji Onishi, Osaka (JP); Minoru Nakanishi, Osaka (JP)

(73) Assignees: Haier Asia International Co., Ltd., Osaka (JP); Qingdao Haier Washing Machine Co., Ltd., Shandong (CN)

( * ) Notice: Subject to any disclaimer, the term of this patent is extended or adjusted under 35 U.S.C. 154(b) by 70 days.

(21) Appl. No.: 15/110,616

(22) PCT Filed: Dec. 31, 2014

(86) PCT No.: PCT/CN2014/095731
§ 371 (c)(1),
(2) Date: Jul. 8, 2016

(87) PCT Pub. No.: WO2015/106630
PCT Pub. Date: Jul. 23, 2015

(65) Prior Publication Data

US 2016/0348293 A1 Dec. 1, 2016

(30) Foreign Application Priority Data

Jan. 14, 2014 (JP) ..... 2014-004666

(51) Int. Cl.
*D06F 35/00* (2006.01)
*D06F 37/30* (2006.01)
(Continued)

(52) U.S. Cl.
CPC ..... *D06F 35/00* (2013.01); *D06F 5/04* (2013.01); *D06F 37/14* (2013.01); *D06F 37/30* (2013.01);
(Continued)

(58) Field of Classification Search
CPC . D06F 35/00; D06F 5/04; D06F 37/14; D06F 37/30; D06F 39/005; D06F 39/028; D06F 39/083; D06F 39/088
See application file for complete search history.

(56) References Cited

U.S. PATENT DOCUMENTS 3,026,699 A * 3/1962 Rhodes ..... D06F 29/00 68/12.19
3,039,286 A 6/1962 Shelton
(Continued)

FOREIGN PATENT DOCUMENTS

CN 1045433 A 9/1990
CN 2503097 Y 7/2002
(Continued)

OTHER PUBLICATIONS

International Search Report dated Apr. 1, 2015 from International Patent Application No. PCT/CN2014/095731 filed Dec. 31, 2014.

*Primary Examiner* — Michael Barr
*Assistant Examiner* — Benjamin L Osterhout
(74) *Attorney, Agent, or Firm* — Sunstone IP

(57) ABSTRACT

A washing machine which enables a user to effectively perform hand washing of washings in a washing and dewatering tank is disclosed. A full-automatic washing machine has: a washing and dewatering tank for performing washing and dewatering of washings; a water supply unit for supplying water into the washing and dewatering tank; a control part for controlling the water supply unit; an auxiliary washing plate which is detachably installed in the washing and dewatering tank and has a shape of concaves and
(Continued)

convexes on an upper surface; and a hand washing water supply button which is operated when the auxiliary washing plate installed in the washing and dewatering tank is used for performing hand washing of washings. Here, the control part supplies water to the water supply unit based on a condition already operated on the hand washing water supply button.

12 Claims, 15 Drawing Sheets

(51) Int. Cl.

| | |
|---|---|
| ***D06F 39/02*** | (2006.01) |
| ***D06F 39/00*** | (2006.01) |
| ***D06F 39/08*** | (2006.01) |
| ***D06F 5/04*** | (2006.01) |
| ***D06F 37/14*** | (2006.01) |

(52) U.S. Cl.
CPC ..... *D06F 39/005* (2013.01); *D06F 39/028* (2013.01); *D06F 39/083* (2013.01); *D06F 39/088* (2013.01)

(56) References Cited

U.S. PATENT DOCUMENTS

| | | | | | |
|---|---|---|---|---|---|
| 3,209,560 | A * | 10/1965 | Shelton | D06F 13/00 | 68/14 |
| 3,490,254 | A * | 1/1970 | Mason | D06F 13/00 | 68/14 |
| 5,253,493 | A * | 10/1993 | Ohashi | D06F 39/14 | 220/812 |
| 7,313,932 | B2 * | 1/2008 | Ryohke | D06F 19/00 | 68/13 R |
| 2002/0134117 | A1 * | 9/2002 | Arai | D06F 19/00 | 68/3 SS |
| 2006/0156763 | A1 * | 7/2006 | Vecchi | D06F 19/00 | 68/3 SS |
| 2015/0247274 | A1 * | 9/2015 | Kim | D06F 39/08 | 68/27 |

FOREIGN PATENT DOCUMENTS

| | | | |
|---|---|---|---|
| CN | 2612706 | Y | 4/2004 |
| CN | 2773126 | Y | 4/2006 |
| CN | 2844179 | Y | 12/2006 |
| CN | 101929050 | A | 12/2010 |
| CN | 102465429 | A | 5/2012 |
| CN | 202834310 | U | 3/2013 |
| CN | 203021787 | U | 6/2013 |
| EP | 1369524 | A1 | 12/2003 |
| JP | 63-052593 | | 4/1988 |
| JP | 04-224793 | A | 8/1992 |
| JP | 07-016389 | A | 1/1995 |
| JP | 2002273092 | A | 9/2002 |
| JP | 2003245497 | A | 9/2003 |
| JP | 2005105681 | A | 4/2005 |
| KR | 19970001664 | A | 1/1997 |
| KR | 20030045447 | A | 6/2003 |

* cited by examiner

WASHING MACHINE

CROSS REFERENCE TO RELATED APPLICATION

This application is a National Stage of International Patent Application No. PCT/CN2014/095731 filed on Dec. 31, 2014, which claims the benefit of Japanese Patent Application No. 2014-004666 filed on Jan. 14, 2014, the disclosures of which are hereby incorporated entirely herein by reference.

TECHNICAL FIELD

The present disclosure relates to a washing machine.

BACKGROUND

Under a condition that for example washings have a heavy stain part, a user sometimes performs hand washing of washings in advance and washes washings with a washing machine after the stain of washings is removed to a certain extent.

In addition, an inner part of a washing tank is divided into two regions including an upper region and a lower region by a partition plate; in the washing machine for separately washing washings in the upper and the lower regions, concaves and convexes in a wave pattern are formed on an upper surface or a lower surface of the partition plate, so that the partition plate can be appropriately removed from the washing tank to use as a washboard (referring to patent document 1).

EXISTING TECHNICAL DOCUMENT

Patent Document

Patent document 1: Japanese Application Publication No. 1-153193

SUMMARY

Problem to Be Solved By the Disclosure

When a user performs hand washing of washings, a device such as a washstand or the like arranged at an undressing position of a bathroom which can supply water are often configured to perform hand washing since water is required to be supplied to washings. In this case, water used for hand washing is abandoned and not used for washing later. Therefore, a problem that water used for hand washing is wasted is generated.

The present disclosure is accomplished in view of such a problem and aims to provide a washing machine capable of performing hand washing and machine washing of washings while efficiently using water.

Means for Solving Subject

The washing machine involved in a main mode of the present disclosure has: a washing and dewatering tank for performing washing and dewatering of washings; a water supply part for supplying water into the washing and dewatering tank; a water supply control part for controlling the water supply part; an auxiliary washing plate which is detachably installed in the washing and dewatering tank and has a shape of concaves and convexes on an upper surface;

and a water supply button which is operated when the auxiliary washing plate installed in the washing and dewatering tank is used for performing hand washing of washings. Here, the water supply control part supplies water to the water supply part based on a condition already operated on the water supply button.

According to the above structure, when the auxiliary washing plate is used in the washing and dewatering tank to perform hand washing of washings, water can be supplied to washings subjected to hand washing. Thus, the user can use the supplied water and the auxiliary washing plate to perform hand washing of washings in the washing and dewatering tank. In addition, because water used for hand washing falls into the washing and dewatering tank, the water can be appropriately accumulated in the washing and dewatering tank so that water used for hand washing can be efficiently used for machine washing.

In the washing machine of such a mode, the water supply part can adopt a structure including a running water supply part which is connected with a water tap and makes running water supplied from the water tap flow toward the auxiliary washing plate from an upper part of the auxiliary washing plate. In this case, the water supply button can adopt a structure including a running water supply button configured to make the running water supply part operate.

According to the above structure, because running water can be watered on washings for hand washing, the user can use clean water for performing hand washing of washings.

Under a condition of adopting the above structure, the washing machine can further adopt a structure that the running water supply part includes a detergent housing part through which running water flows and detergents housed in the detergent housing part are mixed with running water and flow toward the auxiliary washing plate.

By adopting the structure, the user puts detergents in the detergent housing part in advance so that running water containing detergents can be watered on washings for hand washing. Thus, hand washing can be performed more effectively.

In addition, under a condition of adopting the above structure, the washing machine can further adopt a structure that a detecting surface faces inside of the washing and dewatering tank. In this case, the water supply control part can adopt a following structure in which the water supply control part stops water supply based on the running water supply part according to a condition that the human body induction sensor detects no more part of a human body after the running water supply part starts to supply water into the washing and dewatering tank.

By adopting the structure, when hand washing is ended and hands and the like of the user move out of the washing and dewatering tank, supply of running water to the washing and dewatering tank is automatically stopped. Therefore, supply of redundant running water into the washing and dewatering tank can be inhibited.

In the washing machine of the present embodiment, the water supply part can adopt a structure including a circulating water supply part configured to pump up water accumulated in the washing and dewatering tank and make the water flow toward the auxiliary washing plate from an upper part of the washing and dewatering tank. In this case, the water supply button can adopt a structure including a circulating water supply button configured to enable the circulating water supply part operate.

According to the above structure, because water accumulated in the washing and dewatering tank can be watered on washings for hand washing, the user can use water containing detergents in the washing process for performing hand washing of washings. In addition, in hand washing, because water accumulated in the washing and dewatering tank is used for hand washing, hand washing can be performed while efficiently using water.

Under a condition of adopting the above structure, the washing machine can adopt a structure having an impeller configured in the washing and dewatering tank and configured to generate water flows through rotation and a drive motor for driving the impeller. In this case, the circulating water supply part can adopt a structure including a back leaf formed on a back surface of the impeller, and a circulating water path part arranged on a circumference surface of the washing and dewatering tank and configured to make the pumped water flow toward the auxiliary washing plate from an upper discharge port through a water pumping function of the back leaf. Then the water supply control part can adopt a structure which rotates the impeller through the drive motor in a mode that quantity of water which is based on an operation of the water supply button and is discharged from the discharge port is greater than water quantity discharged from the discharge port in a washing process.

By adopting the structure, water accumulated in the washing and dewatering tank can be watered on washings for hand washing without additionally using a circulating pump. Moreover, because water flowing from the discharge port of the circulating water path part is greater than water in the washing process, water can be adequately watered on washings for hand washing.

In the washing machine of the present embodiment, the water supply control part can adopt a structure which does not supply water through the water supply part under a condition that the water supply button is operated in a process after the washing process.

According to the above structure, because water supplying based on operations of the water supply button is not performed in a process after the washing process, washings washed through the washing process cannot be polluted by water used for hand washing.

Effects of the Disclosure

According to the present disclosure, a user can effectively perform hand washing of washings in a washing and dewatering tank.

Effects and significance of the present disclosure are further defined through description of embodiments shown below. However, the embodiments below are only examples when the present disclosure is implemented, and the present disclosure is not limited by any of the embodiments below.

DETAILED DESCRIPTION

Description is made below to a full-automatic washing machine as one embodiment of a washing machine of the present disclosure with reference to drawings.

Figure 1:
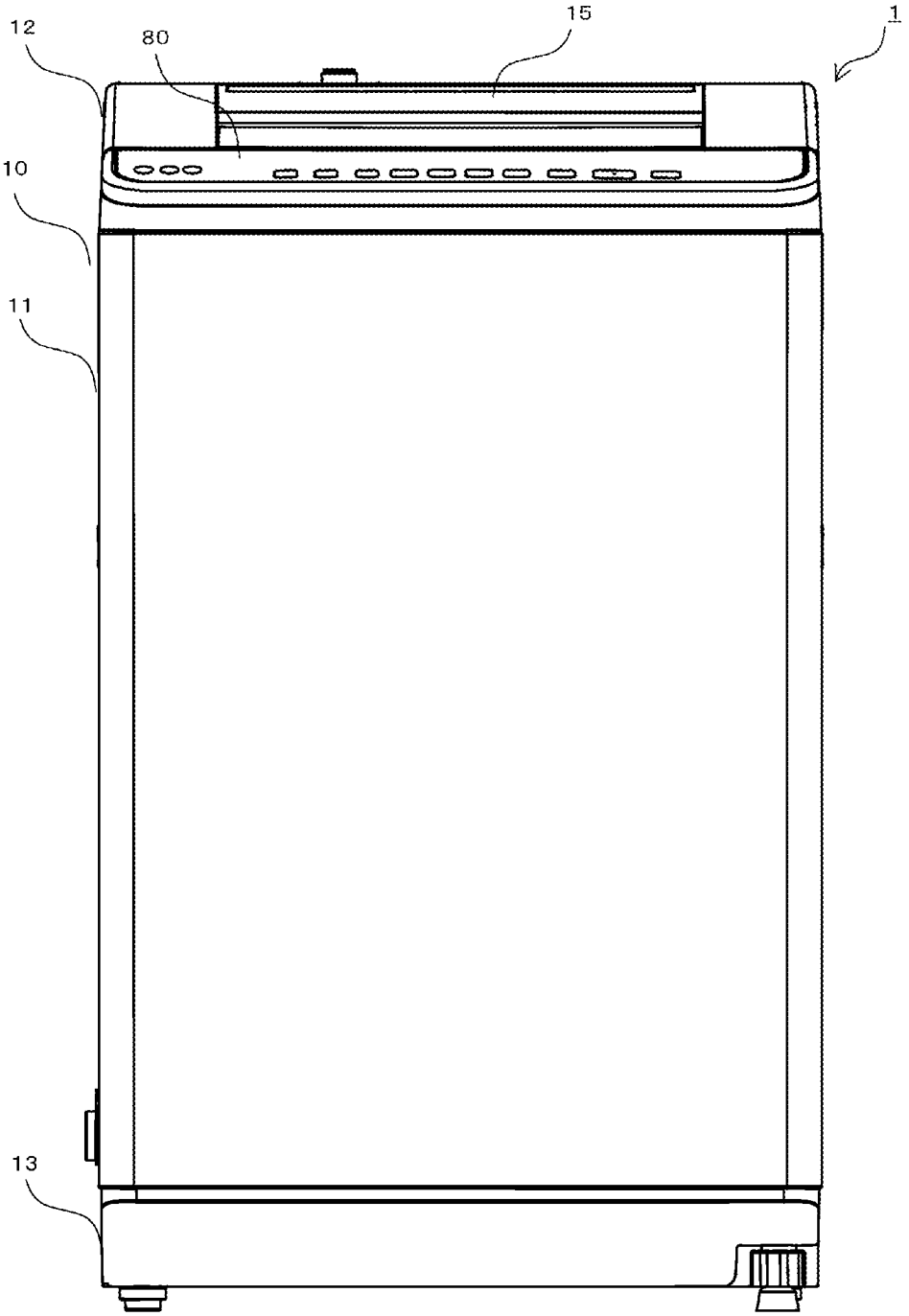
FIG. 1 is a main view showing an appearance of a full-automatic washing machine involved in embodiments.
Figure 2:
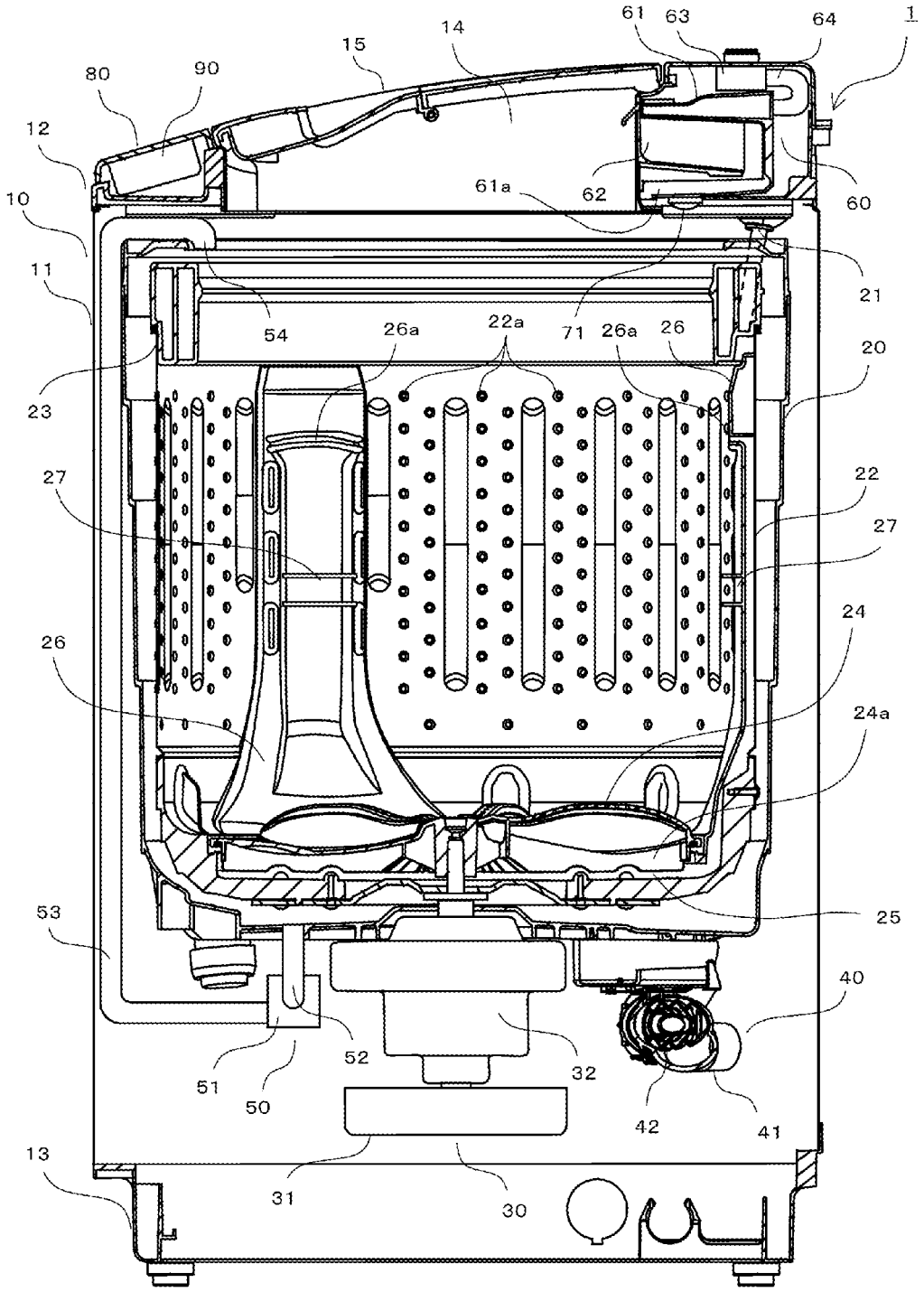
FIG. 2 is a side sectional view showing an internal structure of a full-automatic washing machine involved in embodiments.

FIG. 1 is a main view showing an appearance of a full-automatic washing machine 1. FIG. 2 is a side sectional view showing an internal structure of the full-automatic washing machine 1.

The full-automatic washing machine 1 has a housing 10 forming an appearance. The housing 10 includes: a square tubular machine body part 11 of which an upper and a lower surfaces are opened; an upper panel 12 which is covered on the upper surface of the machine body part 11; and a footstool 13 which supports the machine body part 11. A throwing inlet 14 of washings is formed on the upper panel 12. The throwing inlet 14 is covered by an upper cover 15 which can be freely opened and closed.

In the housing 10, an outer tank 20 is elastically supported upwardly by four hanging rods 21 having anti-vibration devices. A washing and dewatering tank 22 is configured in the outer tank 20. In the washing and dewatering tank 22, a plurality of dewatering holes **22*a* are formed in a circumference surface and a balance ring 23 is arranged on an upper part of the washing and dewatering tank 22**.

An impeller 24 is configured at a bottom of the outer tank 20. A plurality of back leaves **24*a* radically extending from a center of a back surface are formed in the back surface of the impeller 24. The back leaves 24*a* are configured in a pump room 25 formed between the back surface of the impeller 24 and a bottom surface of the washing and dewatering tank 22**.

On an inner circumference surface of the washing and dewatering tank 22, three circulating water path parts 26 extending to an upper and a lower directions are configured in a circumferential direction at roughly equal intervals. A lower end part of each circulating water path part 26 is connected with the pump room 25. A slit-shaped discharge port **26*a* is formed on an upper part of each circulating water path part 26**.

A drive unit 30 configured to drive the washing and dewatering tank 22 and the impeller 24 is configured on an outer bottom of the outer tank 20. The drive unit 30 includes a drive motor 31 and a transfer mechanism 32. The transfer mechanism 32 has a clutch mechanism. Through switching operations performed by the clutch mechanism, in a washing process and a rinsing process, a drive force of the drive motor 31 is only transferred to the impeller 24 so as to only make the impeller 24 rotate. In a dewatering process, a drive force of the drive motor 31 is transferred to the impeller 24 and the washing and dewatering tank 22 so as to make the impeller 24 and the washing and dewatering tank 22 rotate integrally. In addition, the transfer mechanism 32 has a speed reducing mechanism. In a washing process and a rinsing process, the impeller 24 rotates with a reduced speed of rotational speed of the drive motor 31 in accordance with deceleration of the speed reducing mechanism.

A drain unit 40 configured to drain water from the washing and dewatering tank 22 and the outer tank 20 is further configured on the outer bottom of the outer tank 20. The drain unit 40 has a drain pipe 41 and a drain valve 42 and is connected with a drain hose not shown. When the drain valve 42 is opened, water accumulated in the washing and dewatering tank 22 and the outer tank 20 is drained out of the machine through the drain pipe 41 and the drain hose. The drain valve 42 is opened in a drain process and a dewatering process in the washing process and the rinsing process, and is closed when other processes are performed or no washing operation is performed.

A circulating pump unit 50 is configured on an outer side of the outer tank 20. The circulating pump unit 50 includes a circulating pump 51, a water suction hose 52 and a water feeding hose 53. The circulating pump 51 is configured on the outer bottom of the outer tank 20. One end of the water suction hose 52 is connected with a bottom surface of the outer tank 20, and an other end of the water suction hose 52 is connected with a suction inlet of the circulating pump 51. One end of the water feeding hose 53 is connected with the discharge port of the circulating pump 51, and an other end of the water feeding hose 53 is configured on the upper part of the outer tank 20 as a water filling port 54. When the circulating pump 51 is operated, water in the outer tank 20 is drawn by the circulating pump 51 and is drained to the water feeding hose 53. The drained water flows through the water feeding hose 53 and flows from the water filling port 54 into the washing and dewatering tank 22.

A water supply unit 60 for supplying running water into the washing and dewatering tank 22 is configured at a back part of the upper panel 12. The water supply unit 60 includes a water supply port part 61, a detergent housing part 62, a water supply valve 63 and a water supply hose 64. The water supply port part 61 has an opening on its front surface, and the detergent housing part 62 is housed so that the detergent housing part 62 can be put and withdrawn from the front surface opening. The detergent housing part 62 has openings on its upper and back portions. In a washing operation, detergents are thrown by the user into the detergent housing part 62. The water supply valve 63 is connected with a water tap. When the water supply valve 63 is opened, running water is introduced into the water supply port part 61 via the water supply hose 64. Running water introduced into the water supply port part 61 flows into the detergent housing part 62 from the upper part, and is mixed with detergents and flows out of the back of the detergent housing part 62. Outflowing running water flows into the washing and dewatering tank 22 from a water filling port 61*a* formed between the bottom surface of the water supply port part 61 and the bottom surface of the detergent housing part 62.

At the back of the upper panel 12, a human body induction sensor 71 is further configured below the water supply unit 60. A detecting surface of the human body induction sensor 71 faces the inner part of the washing and dewatering tank 22. When hands and arms of the user are inserted into the washing and dewatering tank 22, the inserted hands and arms are detected by the human body induction sensor 71. In addition, the human body induction sensor 71 can also be any form of human body induction sensors, such as infrared form, ultrasonic wave form, etc.

An operating panel 80 is arranged in front of the upper panel 12. Various buttons for a washing operation processing such as a start button, a mode selection button are configured on the operating panel 80. In addition, various display parts for displaying all kinds of information related to washing operations such as a mode display part for displaying a selected operating mode are configured on the operating panel 80.

Figure 3:
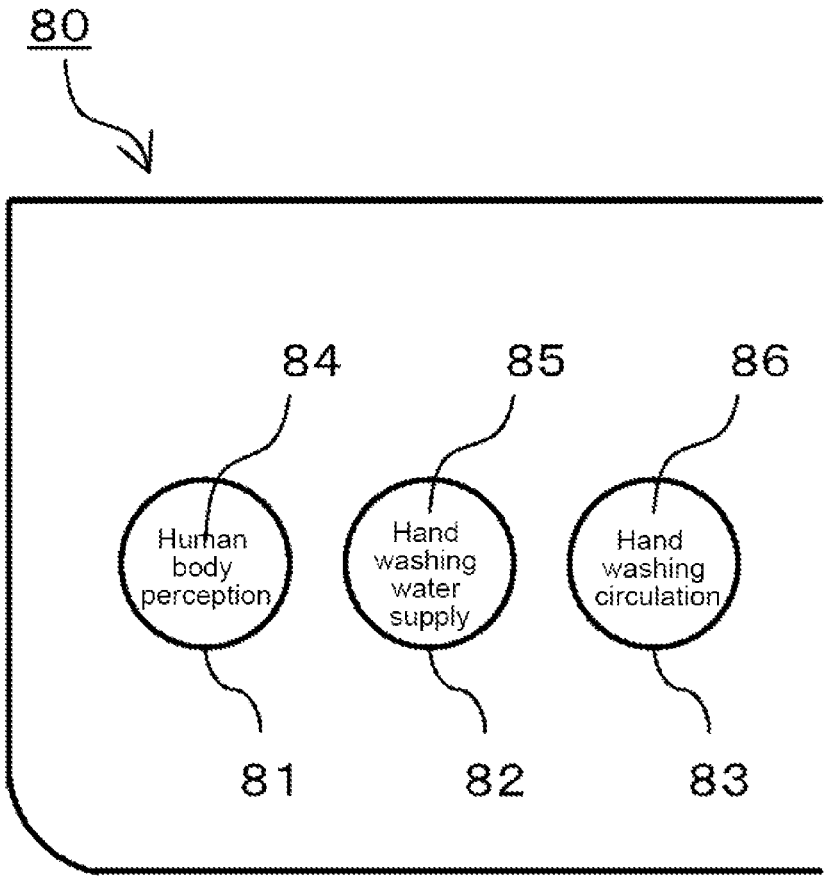
FIG. 3 is a view showing a main part of an operating panel involved in embodiments.

FIG. 3 is a view showing a main part of the operating panel 80. In the full-automatic washing machine 1 of the present embodiment, a human body perception button 81, a hand washing water supply button 82 and a hand washing circulation button 83 are configured on the operating panel 80. The human body perception button 81 is a button for a user to set whether the human body induction sensor 71 is to be started. The hand washing water supply button 82 is a button operated by the user under a condition of performing hand washing water supply operation. The hand washing circulation button 83 is a button operated by the user under a condition of performing hand washing circulating operation. Word parts of the human body perception button 81, the hand washing water supply button 82 and the hand washing circulation button 83 for indicating button names have light transmission. The word parts respectively perform functions as a human body perception display part 84, a hand washing water supply display part 85 and a hand washing circulation display part 86.

Back to FIG. 1 and FIG. 2, a control unit 90 is further configured below the operating panel 80 in front of the upper panel 12.

Figure 4:
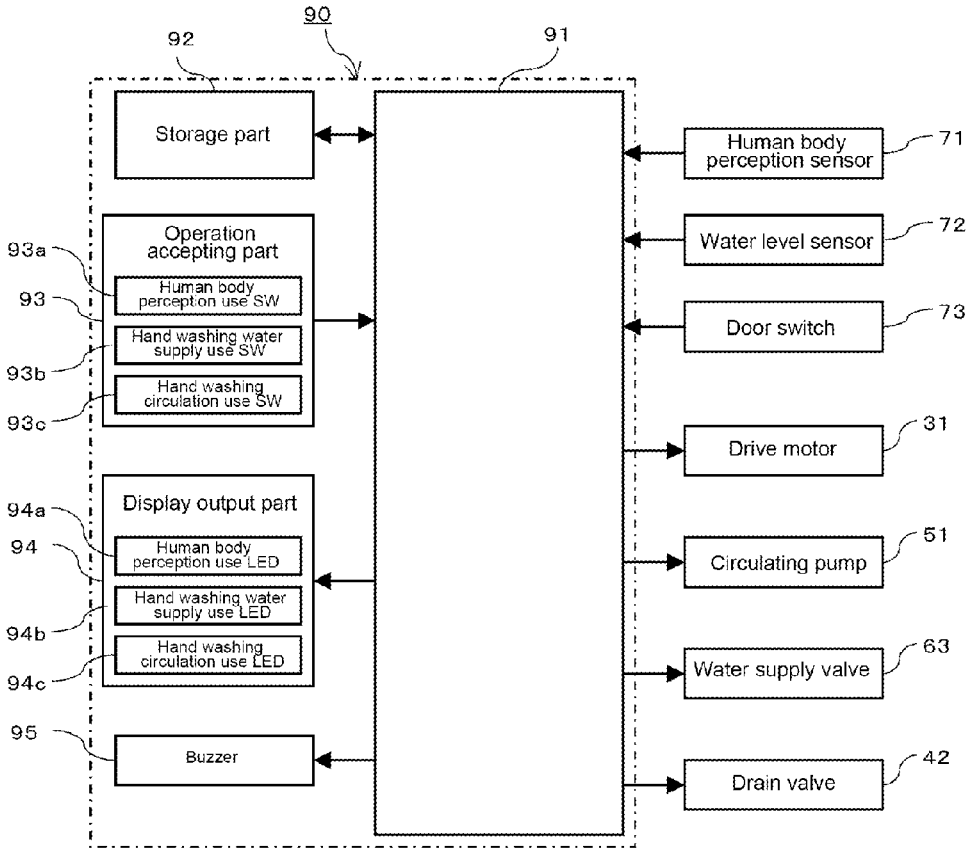
FIG. 4 is a block diagram showing a structure of a control unit involved in embodiments.

FIG. 4 is a block diagram showing a structure of the control unit 90.

The control unit 90 includes a control part 91, a storage part 92, an operation accepting part 93, a display output part 94 and a buzzer 95. In addition, a water level sensor 72 for detecting a water level in the washing and dewatering tank 22, and a door switch 73 for detecting opening and closing of the upper cover 15 are arranged in the full-automatic washing machine 1. The human body induction sensor 71, the water level sensor 72 and the door switch 73 are connected with the control part 91.

When the human body induction sensor 71 detects a part of the human body, such as arms, hands, etc., a human body detection signal is output to the control part 91. The water level sensor 72 outputs a water level detection signal corresponding to a water level in the washing and dewatering tank 22 to the control part 91. The door switch 73 outputs an opening signal or a closing signal to the control part 91 according to the opening and closing of the upper cover 15.

The operation accepting part 93 includes a human body perception use switch 93*a*, a hand washing water supply use switch 93*b* and a hand washing circulating use switch 93*c* corresponding to the human body perception button 81, the hand washing water supply button 82 and the hand washing circulation button 83. In addition, the operation accepting part 93 includes a switch which is arranged on the operating panel 80 and corresponds to other buttons. When any button is operated, an input signal is output from a switch corresponding to the operated button to the control part 91.

The storage part 92 includes an EEPROM, RAM, etc. A program for implementing various operating modes of washing operations and a program for implementing subsequent hand washing control processing are stored in the storage part 92. In addition, various parameters and control marks used in implementation of programs are stored in the storage part 92.

The control part 91 controls various loads such as the drive motor 31, the circulating pump 51, the water supply valve 63, the drain valve 42, the display output part 94, the buzzer 95 and the like in accordance with programs stored in the storage part 92 based on various signals from the operation accepting part 93, the human body induction sensor 71, the water level sensor 72, the door switch 73, etc.

The display output part 94 includes a human body perception use LED 94*a*, a hand washing water supply use LED 94*b* and a hand washing circulating use LED 94*c* corresponding to the human body perception display part 84, the hand washing water supply display part 85 and the hand washing circulation display part 86. In addition, the display output part 94 includes an LED which is arranged on the operating panel 80 and corresponds to other display parts. The display output part 94 illuminates, extinguishes or flashes each LED according to control signals from the control part 91. Thus, each display part performs illumination, extinguishment or flashing.

The buzzer 95 outputs sounds corresponding to control signals from the control part 91. Sounds output from the buzzer 95 include an ending sound indicating an end of a washing operation, an anomaly notifying sound indicating generation of anomaly, and all other sounds.

Then the full-automatic washing machine 1 performs various operating modes of washing operations. The washing operations include a washing process, an intermediate dewatering process, a rinsing process and a final dewatering process.

In the washing process and the rinsing process, in a state that water is accumulated in the washing and dewatering tank 22, the impeller 24 rotates in a left direction and a right direction. Water flows are generated in the washing and dewatering tank 22 through rotation of the impeller 24. In the washing process, washings are washed through generated water flows and detergents contained in water. In the rinsing process, washings are rinsed through generated water flows. In addition, in the washing process and the rinsing process, with the rotation of the impeller 24, the back leaves 24*a* rotate in the pump room 25. Water between the washing and dewatering tank 22 and the outer tank 20 is drawn into the pump room 25 and transported to each circulating water path part 26; and water transported to each circulating water path part 26 flows out of the discharge port 26*a* towards a center of the washing and dewatering tank 22, thus enabling washings above the washing and dewatering tank 22 also contain adequate water.

In the intermediate dewatering process and the final dewatering process, the washing and dewatering tank 22 and the impeller 24 rotate integrally at high speed. Washings are dewatered through a centrifugal effect generated by the washing and dewatering tank 22.

Besides various operating modes of washing operations, the full-automatic washing machine 1 in the present embodiment performs a hand washing water supply operation and a hand washing circulation operation based on operations of the hand washing water supply button 82 and the hand washing circulation button 83. In the hand washing water supply operation, running water is supplied to washings subjected to hand washing in the washing and dewatering tank 22 by the auxiliary washing plate 100 through the water supply unit 60. In the hand washing circulation operation, water accumulated in the washing and dewatering tank 22 is supplied to washings subjected to hand washing in the washing and dewatering tank 22 by the auxiliary washing plate 100 through the circulating pump unit 50.

Figure 5:
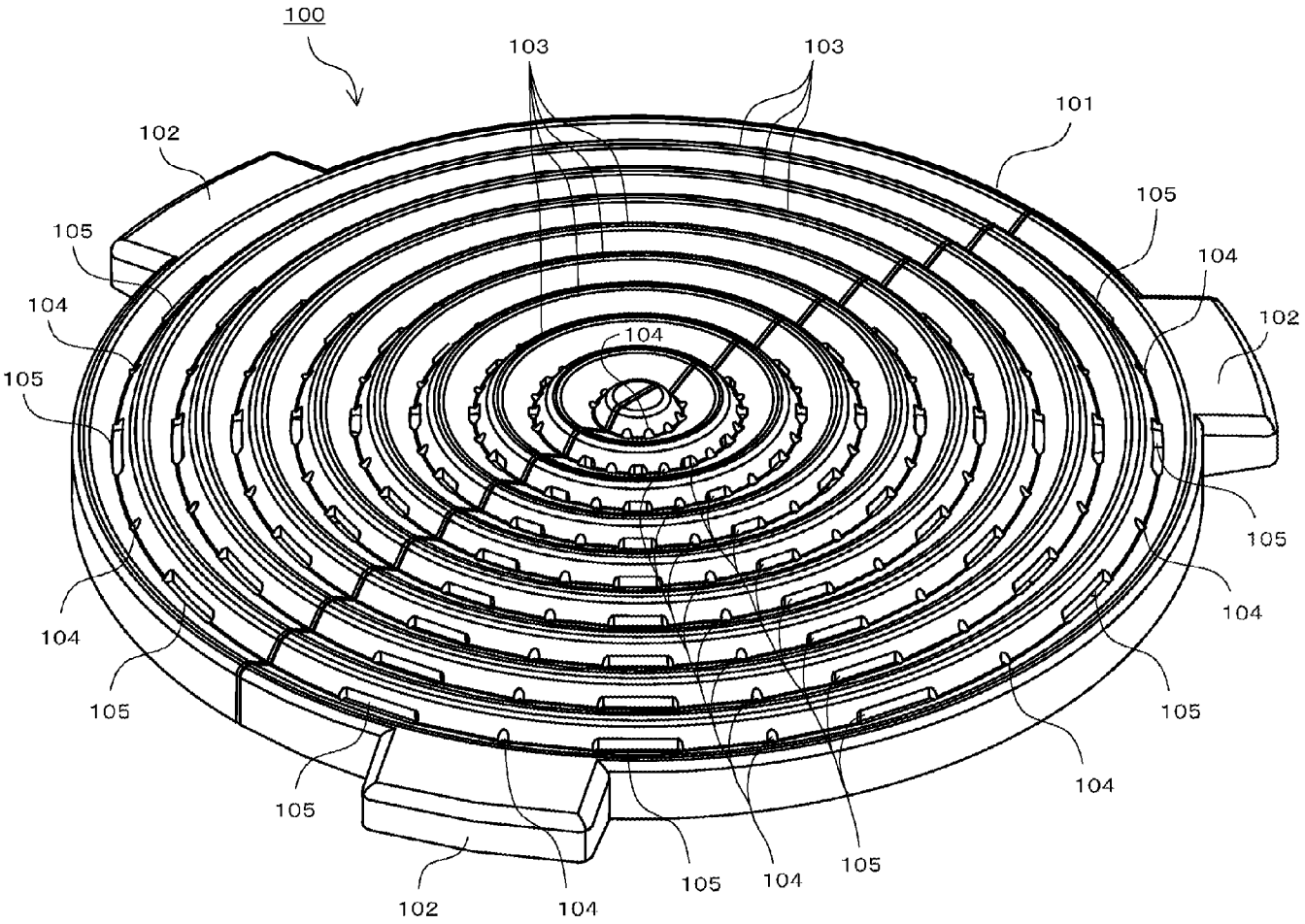
FIG. 5 is a stereoscopic view showing a structure of an auxiliary washing plate involved in embodiments.

FIG. 5 is a stereoscopic view showing a structure of the auxiliary washing plate 100.

The full-automatic washing machine 1 has the auxiliary washing plate 100 which becomes auxiliary for hand washing when washings are subjected to hand washing in the washing and dewatering tank 22. The auxiliary washing plate 100 is composed of a main body plate 101 having a disc shape, and three arm parts 102 formed on an outer circumference part of the main body plate 101 and having intervals as same as intervals of the circulating water path parts 26. An upper surface of the main body plate 101 forms concaves and convexes in a wave pattern by annular convex parts 103 arranged in a concentric shape. On a valley bottom part formed by two annular convex parts 103, first water through holes 104 and second water through holes 105 are alternately formed at roughly fixed intervals along a circumferential direction. The first water through holes 104 are circular holes, and the second water through holes 105 are long holes which are longer in the circumferential direction. The second water through holes 105 are formed in such a manner that the closer to a center, the shorter a length along the circumferential direction. Only the first water through holes 104 are formed on a central-most valley bottom part. The auxiliary washing plate 100 is detachably installed in the washing and dewatering tank 22.

Figure 6:
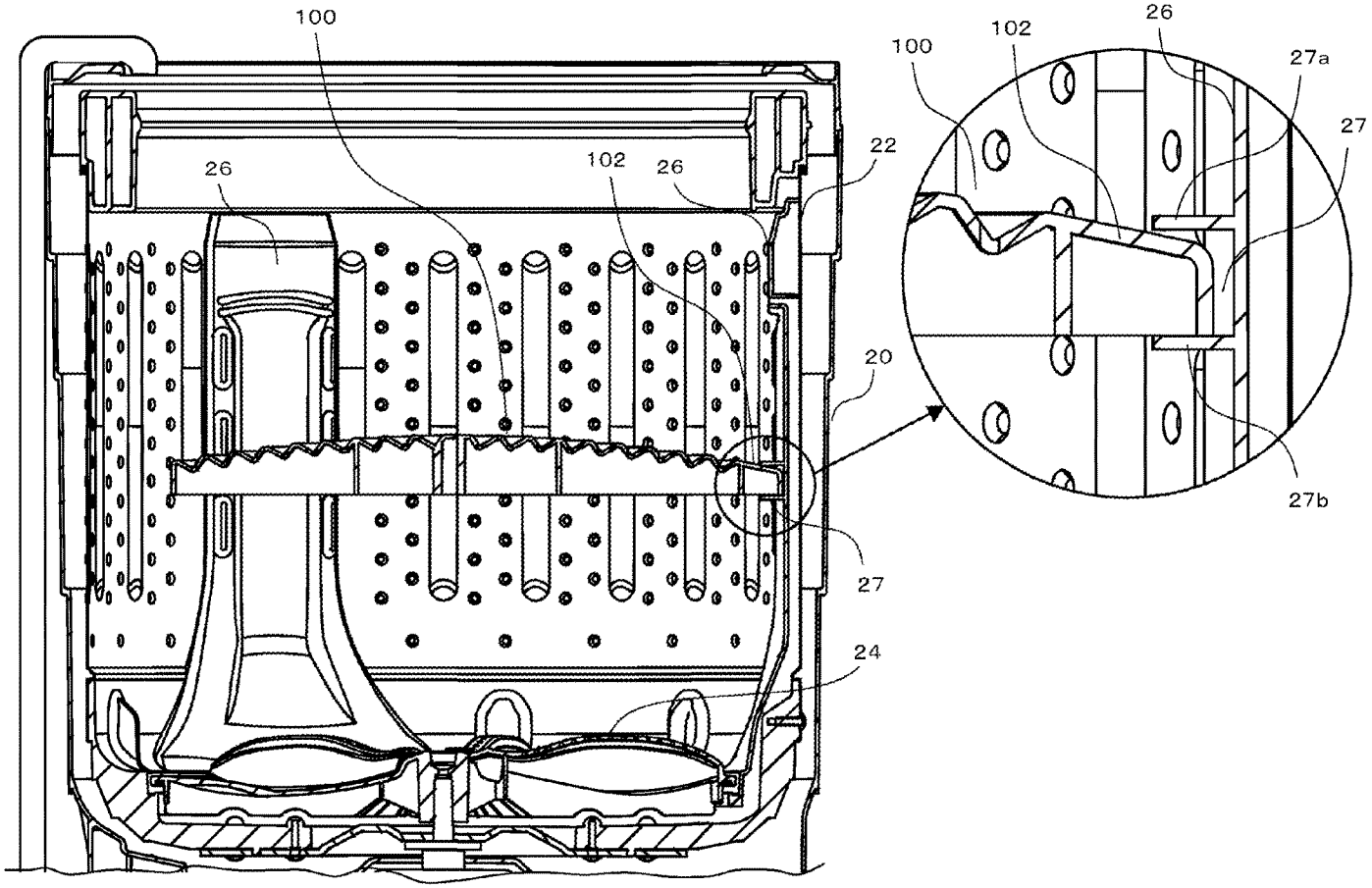
FIG. 6 is a side sectional view showing an outer tank as well as a washing and dewatering tank in a state that the auxiliary washing plate is installed in the washing and dewatering tank involved in embodiments.

FIG. 6 is a side sectional view showing the outer tank 20 as well as the washing and dewatering tank 22 in a state that the auxiliary washing plate 100 is installed in the washing and dewatering tank 22.

To install the auxiliary washing plate 100 in the washing and dewatering tank 22, installation parts 27 are respectively formed in the three circulating water path parts 26. Each installation part 27 is composed of an upper rib 27*a* and a lower rib 27*b* for clamping the arm parts 102 of the auxiliary washing plate 100 from top to bottom. Under a condition of installing the auxiliary washing plate 100, the auxiliary washing plate 100 is configured by the user in a position where each arm part 102 is arranged beside each installation part 27 and is as high as each installation part 27; then the auxiliary washing plate 100 rotates in a horizontal direction; and each arm part 102 is inserted between the upper rib 27*a* and the lower rib 27*b* along a transverse direction. In this way, as shown in FIG. 6, in the washing and dewatering tank 22, the auxiliary washing plate 100 is kept by the three installation parts 27 in an unmovable mode in upward and downward directions.

A height position of each installation part 27 may be set in a position in which water splashed on the auxiliary washing plate 100 does not leak outside the washing machine and hands of a user can easily arrive up to the installed auxiliary washing plate 100 when water is supplied toward the auxiliary washing plate 100 installed in the washing and dewatering tank 22. In the present embodiment, each installation part 27 is arranged in a roughly central location of the washing and dewatering tank 22.

Next, a hand washing control processing executed for a hand washing water supply operation and a hand washing circulation operation through the control part 91 are described.

Figure 7:
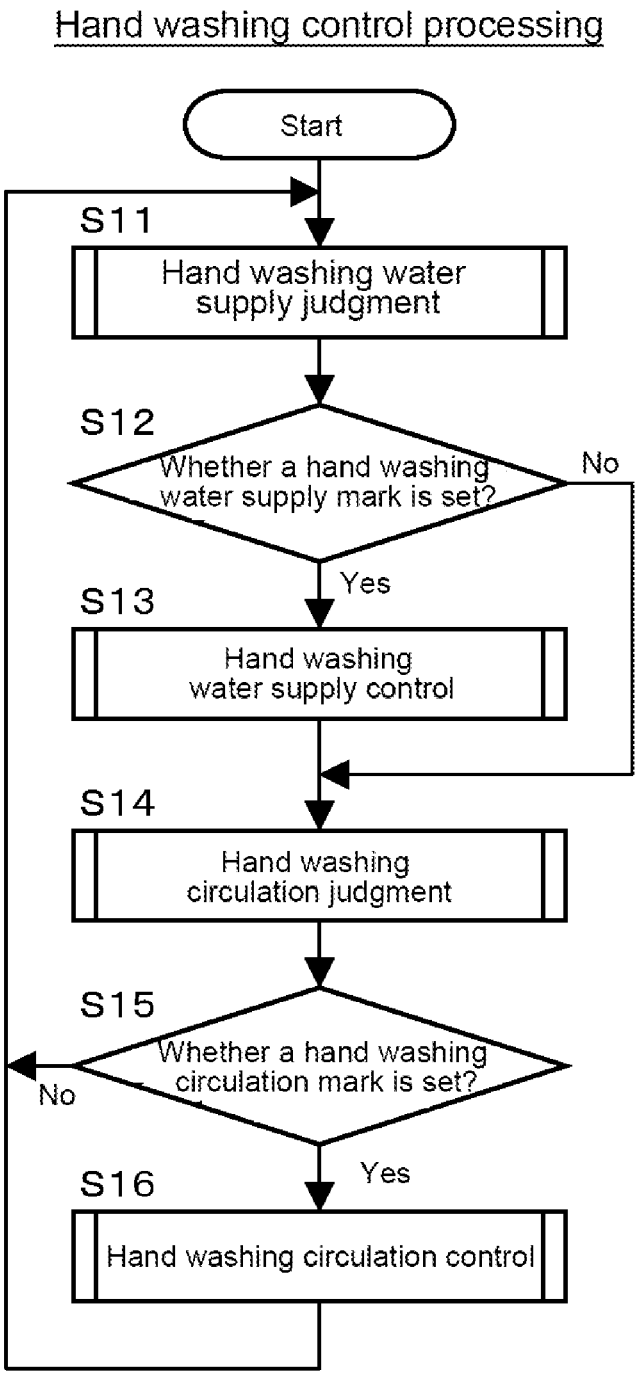
FIG. 7 is a flow chart showing a main routine of a hand washing control processing involved in embodiments.

FIG. 7 is a flow chart showing a main routine of a hand washing control processing. FIG. 8, FIG. 9, FIG. 10 and FIG. 11 are flow charts respectively showing hand washing control processing subroutines, i.e., a hand washing water supply judgment processing, a hand washing water supply control processing, a hand washing circulation judgment processing and a hand washing circulation control processing.

Each processing of the main routine is executed repeatedly during energization of the full-automatic washing machine 1.

Figure 8:
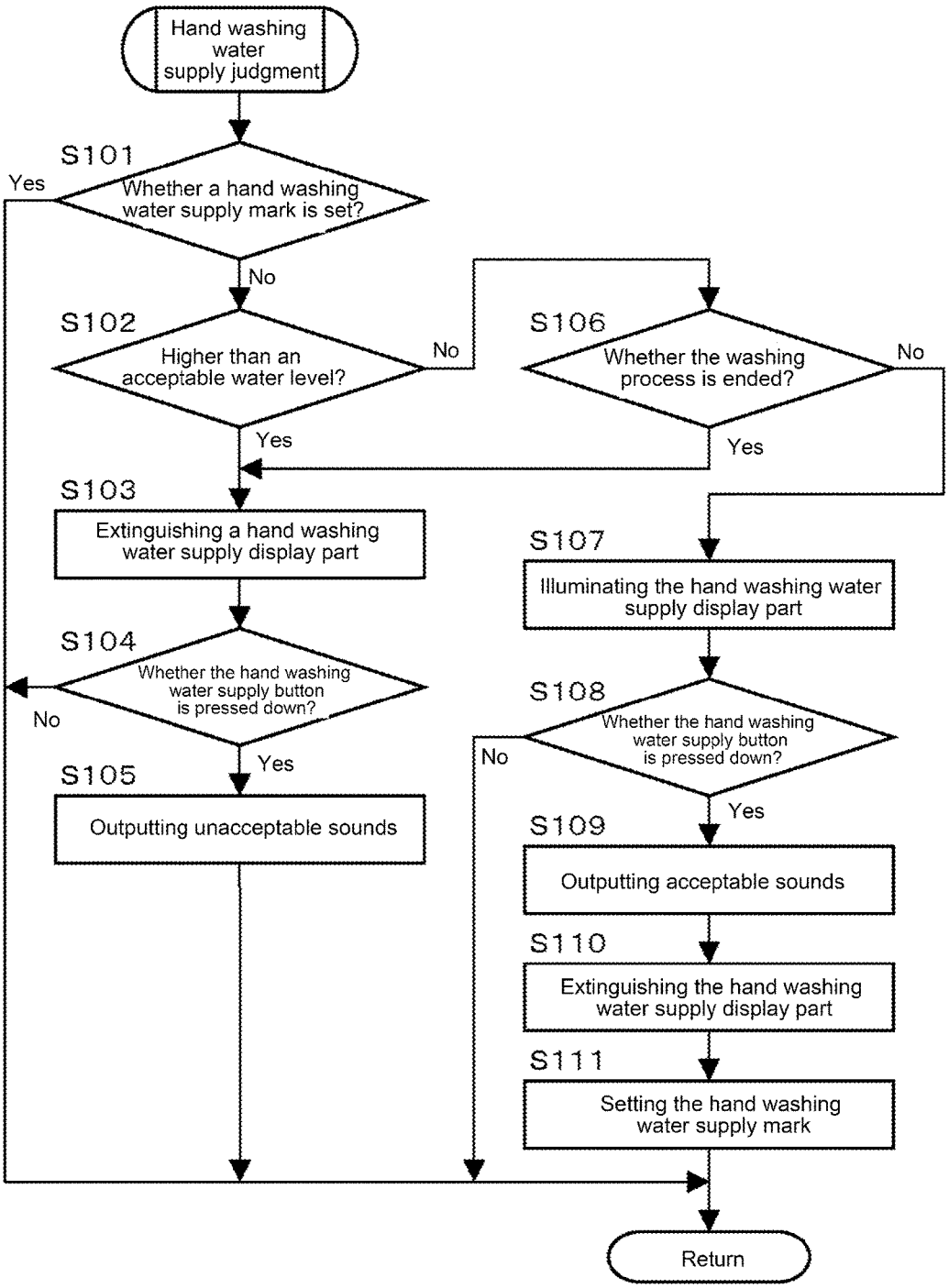
FIG. 8 is a flow chart showing a hand washing water supply judgment processing involved in embodiments.
Figure 9:
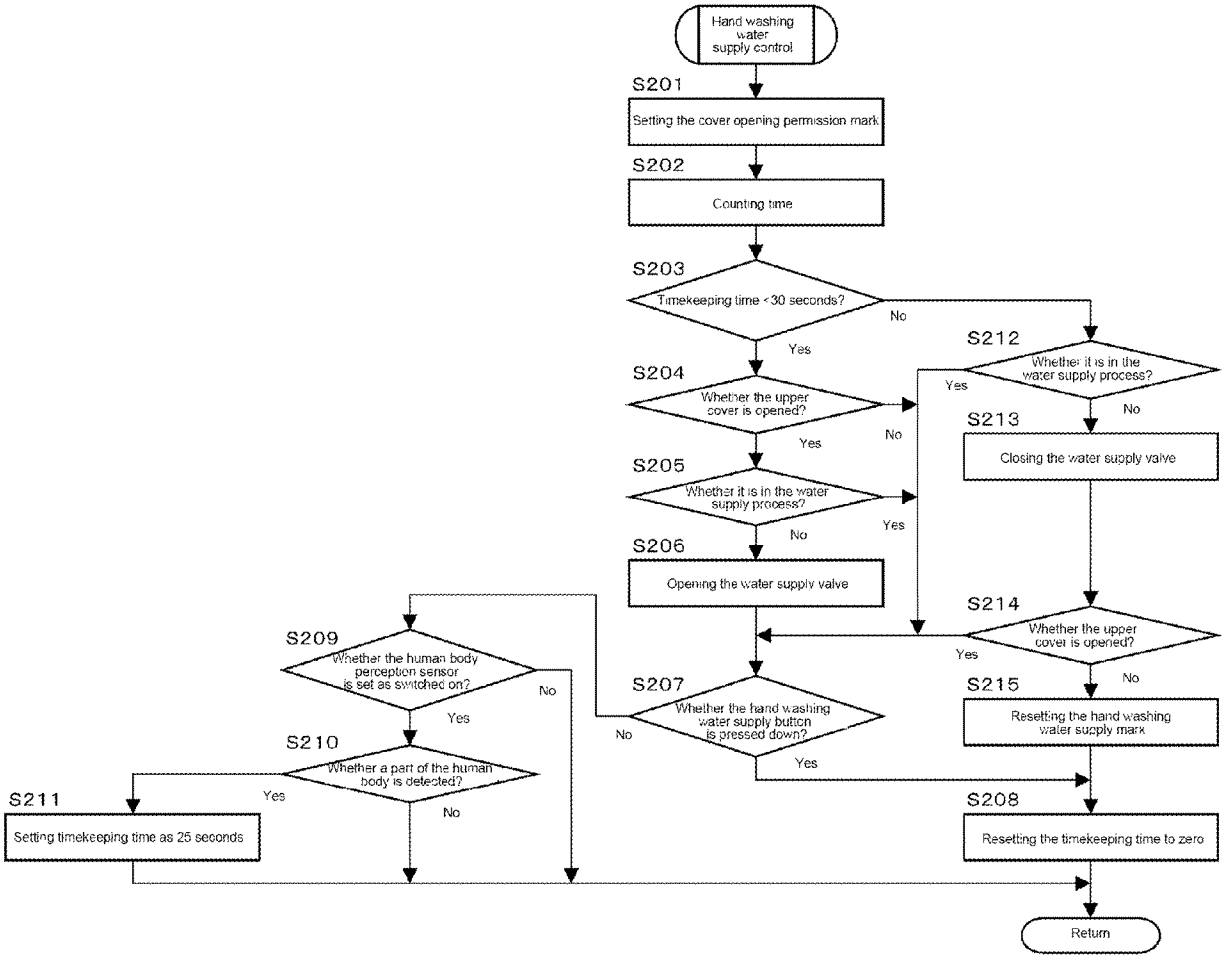
FIG. 9 is a flow chart showing a hand washing water supply control processing involved in embodiments.

The control part 91 firstly executes a water supply judgment processing (S11) shown in FIG. 8. The control part 91 judges whether a hand washing water supply mark is set (S101). The hand washing water supply mark is a control mark used for judging whether to perform the hand washing water supply control processing. In an initial state, the hand washing water supply mark is reset. Under a condition that the hand washing water supply mark is reset (S101: No), the control part 91 judges whether a current water level in the washing and dewatering tank 22 is higher than an acceptable water level (S102).

For example, when standard time hand washing is performed, the acceptable water level is set as a water level as high as possible at which water does not overflow from an overflow port arranged at an upper part of the outer tank 20 due to water supply of the water supply unit 60. When the acceptable water level is set as such a water level, a part of water containing detergents in the washing and dewatering tank 22 can be inhibited from draining outside the washing machine due to water supply under a hand washing water supply operation.

For example, under a condition of performing a washing operation at a water level higher than the acceptable water level, the current water level is higher than the acceptable water level. On the other hand, for example, under a condition that no water exists in the washing and dewatering tank 22 since a washing operation is not started, or under a condition that a washing operation is performed at a water level below the acceptable water level, the current water level is below the acceptable water level.

Under a condition that the current water level is higher than the acceptable water level (S102: Yes), the control part 91 makes the hand washing water supply display part 85 in an extinguished state (S103). Thus, the user can learn that a hand washing water supply operation cannot be performed. Next, the control part 91 judges whether the hand washing water supply button 82 is pressed down (S104). No matter whether the hand washing water supply display part 85 is extinguished, under a condition of pressing down the hand washing water supply button 82 (S104: Yes), the control part 91 returns to the main routine after the buzzer 95 outputs unacceptable sounds indicating that an operation is unacceptable (S105). According to the unacceptable sounds, the user can learn that the operation is not accepted.

On the other hand, under a condition that the current water level is below the acceptable water level (S102: No), the control part 91 now performs a washing operation and judges whether a washing process is ended in the washing operation process (S106). Under a condition that the washing process is ended (S106: Yes), similar to the condition that the current water level is higher than the acceptable water level, the control part 91 executes a processing of step S103 to step S105.

Under a condition that the washing operation is not performed or the washing process is not ended in the washing operation process (S106: No), the control part 91 makes the hand washing water supply display part 85 in an illuminated state (S107). Thus, the user can learn that a hand washing water supply operation can be performed. Next, the control part 91 judges whether the hand washing water supply button 82 is pressed down (S108). Under a condition of pressing down the hand washing water supply button 82 (S108: Yes), the control part 91 outputs acceptable sounds from the buzzer 95 indicating that an operation is acceptable (S109). According to the acceptable sounds, the user can learn that the operation is already accepted. The control part 91 sets the hand washing water supply mark (S111) and returns to the main routine after making the hand washing water supply display part 85 in a flashing state (S110). Through flashing of the hand washing water supply display part 85, the user can learn that a hand washing water supply operation is started.

After the hand washing water supply mark is set in step S111, the hand washing water supply judgment processing is not performed essentially because it is judged in step S101 that the hand washing water supply mark is set and the processing returns to the main routine.

When the hand washing water supply judgment processing returns to the main routine, the control part 91 judges whether the hand washing water supply mark is set (S12). Under a condition that the hand washing water supply mark is set (S12: Yes), the control part 91 executes a hand washing water supply control processing (S13) shown in FIG. 9. The control part 91 sets an cover opening permission mark (S201). The cover opening permission mark is a control mark used for determining whether the upper cover 15 in a washing operation is permitted to be opened. When the cover opening permission mark is set, the upper cover 15 in the washing process is permitted to be opened; and no failure processing such as a failure notification is performed even under a condition that the upper cover 15 is opened in the washing process. In addition, the failure processing is generally performed when the upper cover 15 is opened in the washing process.

Next, the control part 91 performs timing (S202). A timer is arranged in the control part 91. Time of the timer is updated in each timing in step S202. The control part 91 judges whether time is shorter than predetermined water supply time of 30 seconds (S203). Under a condition that the time is shorter than 30 seconds (S203: Yes), the control part 91 judges whether the upper cover 15 is opened (S204). Under a condition that the upper cover 15 is opened (S204: Yes), the control part 91 judges whether it is just in a duration of the water supply process in the washing process (S205); and under a condition that it is just not in the duration of the water supply process (S205: No), the water supply valve 63 is opened (S206). Thus, running water is supplied into the washing and dewatering tank 22 from the water filling port 61*a* of the water supply unit 60.

Under a condition that the upper cover 15 is closed (S204: No) and under a condition that it is just in the duration of the water supply process (S205: Yes), the control part 91 does not perform a processing of step S206. Under a condition that the upper cover 15 is closed, the water supply valve 63 is not opened. Under a condition that it is just in the duration of the water supply process, according to a control processing of an additionally executed washing operation, the water supply valve 63 is already opened.

Next, the control part 91 judges whether the hand washing water supply button 82 is pressed down (S207). Under a condition of pressing down the hand washing water supply button 82 (S207: Yes), the control part 91 resets time in the timer to zero (S208) and returns to the main routine.

On the other hand, under a condition of not pressing down the hand washing water supply button 82 (S207: No), the control part 91 judges whether the human body induction sensor 71 is set as switched on (S209). When the full-automatic washing machine 1 is dispatched from a factory, the human body induction sensor 71 is set as switched on. Under a condition that the human body induction sensor 71 is set as switched on, the human body perception display part 84 is illuminated. Under a condition that the human body induction sensor 71 is set as switched on, when the human body perception button 81 is pressed down, the human body induction sensor 71 is set as switched off and the human body perception display part 84 is extinguished. Under a condition that the human body induction sensor 71 is set as switched off, when the human body perception button 81 is pressed down again, the human body induction sensor 71 is set as switched on and the human body perception display part 84 is illuminated. Such a switching-on/switching-off setting processing of the human body induction sensor 71 and the hand washing control processing are simultaneously executed by the control part 91. A setting result is stored in the storage part 92, and is continuously stored in the storage part 92 even under a state that the full-automatic washing machine 1 is not energized.

Under a condition that the human body induction sensor 71 is set as switched on (S209: Yes), the control part 91 judges through the human body induction sensor 71 whether a part of the human body is detected, i.e., arms and hands of the user (S210). Under a condition that a part of the human body is detected (S210: Yes), the control part 91 sets timekeeping time as 25 seconds (S211) and returns to the main routine. Under a condition that the human body induction sensor 71 is set as switched off (209: No) and under a condition that no part of the human body is detected (210: No), the control part 91 returns to the main routine.

Under a condition that the human body induction sensor 71 is set as switched off and under a condition that the hand washing water supply button 82 is not pressed down within 30 seconds from previous pressing, the timekeeping time reaches 30 seconds. In addition, under a condition that the human body induction sensor 71 is set as switched on, and under a condition that a state, in which no part of the human body is detected after the timekeeping time is set as 25 seconds, is sustained for 5 seconds, the timekeeping time reaches 30 seconds.

Under a condition that the time reaches 30 seconds (S203: No), the control part 91 judges whether it is just in the duration of the water supply process (S212). Under a condition that it is just not in the duration of the water supply process (S212: No), the control part 91 closes the water supply valve 63 (S213). Thus, supply of running water into the washing and dewatering tank 22 from the water supply unit 60 is stopped. On the other hand, under a condition that it is just in the duration of the water supply process (S212: Yes), the control part 91 does not perform the processing of step S213 and moves to the processing of step S207. Water supply into the washing and dewatering tank 22 in the water supply process is continuously performed.

When the water supply valve 63 is closed in step S213, the control part 91 judges whether the upper cover 15 is opened (S214). Under a condition that the upper cover 15 is closed (S214: No), the control part 91 resets the timekeeping time to zero (S208) and returns to the main routine after resetting the hand washing water supply mark (S215). On the other hand, under a condition that the upper cover 15 is opened (S214: Yes), the control part 91 moves to the processing of step S207.

Figure 10:
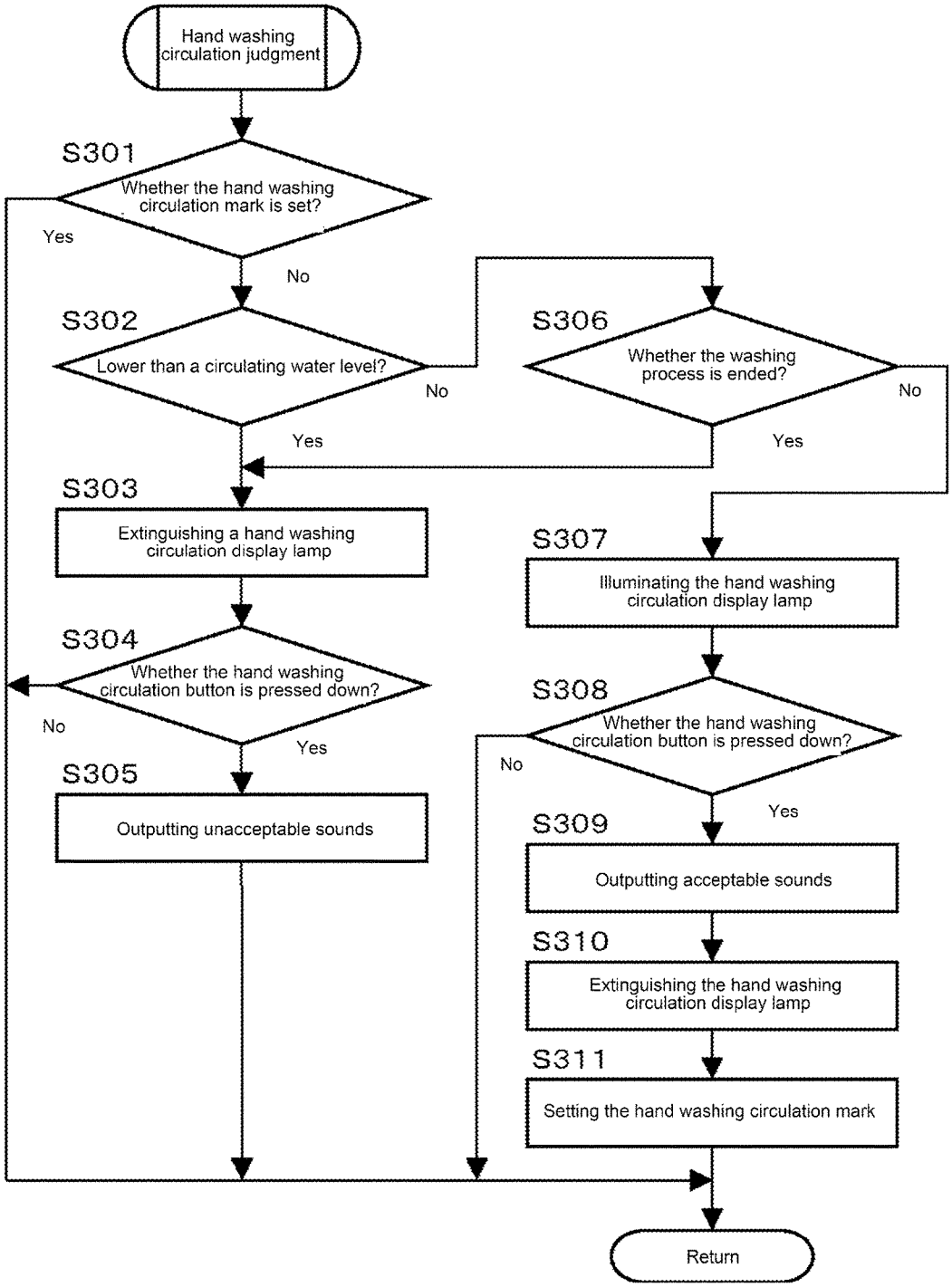
FIG. 10 is a flow chart showing a hand washing circulation judgment processing involved in embodiments.

When returning to the main routine from the hand washing water supply control processing, the control part 91 executes a hand washing circulation judgment processing (S14) shown in FIG. 10. The control part 91 judges whether the hand washing circulation mark is already set (S301). The hand washing circulation mark is a control mark used for judging whether to perform a hand washing circulation control processing. In an initial state, the hand washing circulation mark is reset. Under a condition that the hand washing circulation mark is reset (S301: No), the control part 91 judges whether a current water level in the washing and dewatering tank 22 is lower than a circulating water level (S302).

The circulating water level, for example, is set as a lower limit water level which can circulate water in the washing and dewatering tank 22 through the circulating pump unit 50. For example, under a condition of performing a washing operation at a water level higher than the circulating water level, a current water level is higher than the circulating water level. On the other hand, for example, under a condition that no water exists in the washing and dewatering tank 22 or under a condition that the washing operation is performed at a water level lower than the circulating water level, the current water level is lower than the circulating water level since the washing operation is not started.

Under a condition that the current water level is lower than the circulating water level (S302: Yes), the control part 91 makes the hand washing circulation display part 86 in an extinguished state (S303). Thus, the user can learn that a hand washing circulation operation cannot be performed. Next, the control part 91 judges whether the hand washing circulation button 83 is pressed down (S304). No matter whether the hand washing circulation display part 86 is in the extinguished state, under a condition of pressing down the hand washing circulation button 83 (S304: Yes), the control part 91 returns to the main routine after unacceptable sounds are output from the buzzer 95 (S305). In this way, under a condition that a water level in the washing and dewatering tank 22 is lower than the circulating water level and circulation of water cannot be performed through the circulating pump unit 50, the meaningless hand washing circulation operation can be inhibited since the hand washing circulation operation is stopped.

On the other hand, under a condition that the current water level is higher than the circulating water level (S302: No), the control part 91 judges whether the washing process is ended (S306). Under a condition that the washing process is ended (S306: Yes), similar to the condition that the current water level is lower than the circulating water level, the control part 91 executes a processing of step S303 to step S305.

Under a condition that the washing process is not ended (S306: No), the control part 91 makes the hand washing circulation display part 86 in an illuminated state (S307). Thus, the user can learn that a hand washing circulation operation can be performed. Next, the control part 91 judges whether the hand washing circulation button 83 is pressed down (S308). Under a condition of pressing down the hand washing circulation button 83 (S308: Yes), the control part 91 outputs acceptable sounds from the buzzer 95 (S309). Then the control part 91 sets the hand washing circulation mark (S311) and returns to the main routine after making the hand washing circulation display part 86 in a flashing state (S310). Through flashing of the hand washing circulation display part 86, the user can learn that the hand washing circulation operation is started.

After the hand washing circulation mark is set in step S311, the hand washing circulation judgment processing is not performed essentially because it is judged in step S301 that the hand washing circulation mark is set and the processing returns to the main routine.

When returning to the main routine from the hand washing circulation judgment processing, the control part 91 judges whether the hand washing circulation mark is set (S15). Under a condition that the hand washing circulation mark is set (S15: Yes), the control part 91 executes a hand washing circulation control processing (S16) shown in FIG. 11. The control part 91 sets an cover opening permission mark (S401). When the cover opening permission mark is set, no failure processing is performed even under a condition that the upper cover 15 is opened in the washing process.

Next, the control part 91 judges whether the cover opening mark is already set (S402). The cover opening mark is a control mark for indicating whether the upper cover 15 is in an open state or a closed state. Under a condition that the cover opening mark is not set (S402: No), the control part 91 judges whether the upper cover 15 is opened (S403). When the upper cover 15 is opened (S403: Yes), the control part 91 sets the cover opening mark (S404) and returns to the main routine. When the cover opening mark is set, the control part 91 judges that the cover opening mark is already set in step S402 until the upper cover 15 is closed.

When the control part 91 judges that the cover opening mark is already set (S402: Yes), judges whether the upper cover 15 is closed (S405). As long as the upper cover 15 is not closed (S405: No), the control part 91 makes the circulating pump 51 operate (S406) and returns to the main routine. Thus, water accumulated in the washing and dewatering tank 22 is pumped into the circulating pump 51, and water delivered from the circulating pump 51 flows into the washing and dewatering tank 22 from the water filling port 54. Water circulated through the circulating pump unit 50 is water used for the washing process, and contains detergents.

When the upper cover 15 is closed in an operation of the circulating pump 51, the control part 91 judges in step S405 that the upper cover 15 is closed (S405: Yes). In this case, the control part 91 stops the circulating pump 51 (S407). Thus, water supply into the washing and dewatering tank 22 based on the circulating pump unit 50 is stopped. The control part 91 resets the cover opening mark (S408), resets the hand washing circulation mark (S409) and returns to the main routine.

By executing the hand washing control processing described above, a hand washing water supply operation or a hand washing circulation operation is performed.

Under a condition that the user performs hand washing of washings in the washing and dewatering tank 22 by using running water, in a state of not performing a washing operation, or in a state of performing the washing process, the auxiliary washing plate 100 is installed in the washing and dewatering tank 22 and the hand washing water supply button 82 is pressed down. The hand washing water supply operation is started, and running water flows out of the water supply unit 60. Hands and washings are inserted into the washing and dewatering tank 22 together by the user for performing hand washing of washings in a mode of washings rubbing on a surface of the auxiliary washing plate 100. At this moment, running water is watered on washings from an upper part. Water used for hand washing flows downwardly to a lower part of the auxiliary washing plate 100 and is accumulated in the washing and dewatering tank 22. In addition, under a condition that running water containing detergents is watered on washings, detergents are put into the detergent housing part 62 by the user in advance.

Under a condition that the human body induction sensor 71 is set as switched on, during a period that the user inserts hands into the washing and dewatering tank 22, i.e., during a period that hand washing of washings is performed in the washing and dewatering tank 22, water is continuously supplied into the washing and dewatering tank 22. When hand washing is ended and hands are removed from the washing and dewatering tank 22 by the user, water supply is stopped after 5 seconds. On the other hand, under a condition that the human body induction sensor 71 is set as switched off, water supply is performed for 30 seconds. As long as the hand washing water supply button 82 is pressed down during this period, water supply is performed for another 30 seconds from this moment.

On the other hand, under a condition that the user performs hand washing of washings in the washing and dewatering tank 22 by using water containing detergents in the washing process, in a state of performing the washing process, the auxiliary washing plate 100 is installed in the washing and dewatering tank 22 and the hand washing water supply button 82 is pressed down. The hand washing circulation operation is started. During a period that the upper cover 15 is opened, water containing detergents is circulated through the circulating pump unit 50 and watered on washings for hand washing. When hand washing is ended and the upper cover 15 is closed by the user, water supply based on the circulating pump unit 50 is stopped.

In addition, in the washing process, under a condition that the hand washing water supply button 82 and the hand washing circulation button 83 are both pressed down, running water from the water supply unit 60 and water pumped up by the circulating pump unit 50 from the washing and dewatering tank 22 are both watered on washings. In this case, the user can use more water for performing hand washing of washings.

In this way, according to the present embodiment, when the auxiliary washing plate 100 is used in the washing and dewatering tank 22 to perform hand washing of washings, water can be supplied to washings subjected to hand washing. Thus, the user can use the supplied water and the auxiliary washing plate 100 to perform hand washing of washings in the washing and dewatering tank 22. Moreover, because water used for hand washing falls into the washing and dewatering tank 22, the water can be appropriately accumulated in the washing and dewatering tank 22 so that water used for hand washing can be efficiently used for machine washing.

Then according to the present embodiment, because running water can be watered on washings for hand washing, the user can use clean water to perform hand washing of washings. Moreover, the user puts detergents in the detergent housing part 62 in advance so that running water containing detergents can be watered on washings for hand washing. Thus, hand washing can be performed more effectively.

Then, according to the present embodiment, because water accumulated in the washing and dewatering tank 22 can be watered on washings for hand washing, the user can use water containing detergents in the washing process to perform hand washing of washings. In addition, because water accumulated in the washing and dewatering tank 22 can be used for hand washing when performing hand washing, hand washing can be performed while efficiently using water.

Then, according to the present embodiment, because water supplying based on operations of the hand washing water supply button 82 and the hand washing circulation button 83 is not performed in a process after the washing process, washings washed through the washing process cannot be polluted by water used for hand washing.

Then, according to the present embodiment, when hand washing is ended and hands and the like of the user move out of the washing and dewatering tank 22, supply of running water to the washing and dewatering tank 22 is automatically stopped. Thus, supply of redundant running water into the washing and dewatering tank 22 can be inhibited.

Although embodiments of the present disclosure are described above, the present disclosure is not limited by above embodiments and the like. In addition, various modifications can further be made to embodiments of the present disclosure except for above embodiments.

<Changed Embodiment 1>

In the present changed embodiment, the circulating pump unit 50 is not used in the hand washing circulation operation. That is, in the present changed embodiment, in the hand washing circulation operation, water accumulated in the washing and dewatering tank 22 is pumped up through a water pumping effect of the back leaves 24*a* of the impeller 24, discharged from the discharge port 26*a* of each circulating water path part 26, and supplied to washings for hand washing in the washing and dewatering tank 22.

In addition, like the present changed embodiment, under a condition that the circulating pump unit 50 is not used in the hand washing circulation operation, the circulating pump unit 50 may not be arranged in the full-automatic washing machine 1.

Figure 11:
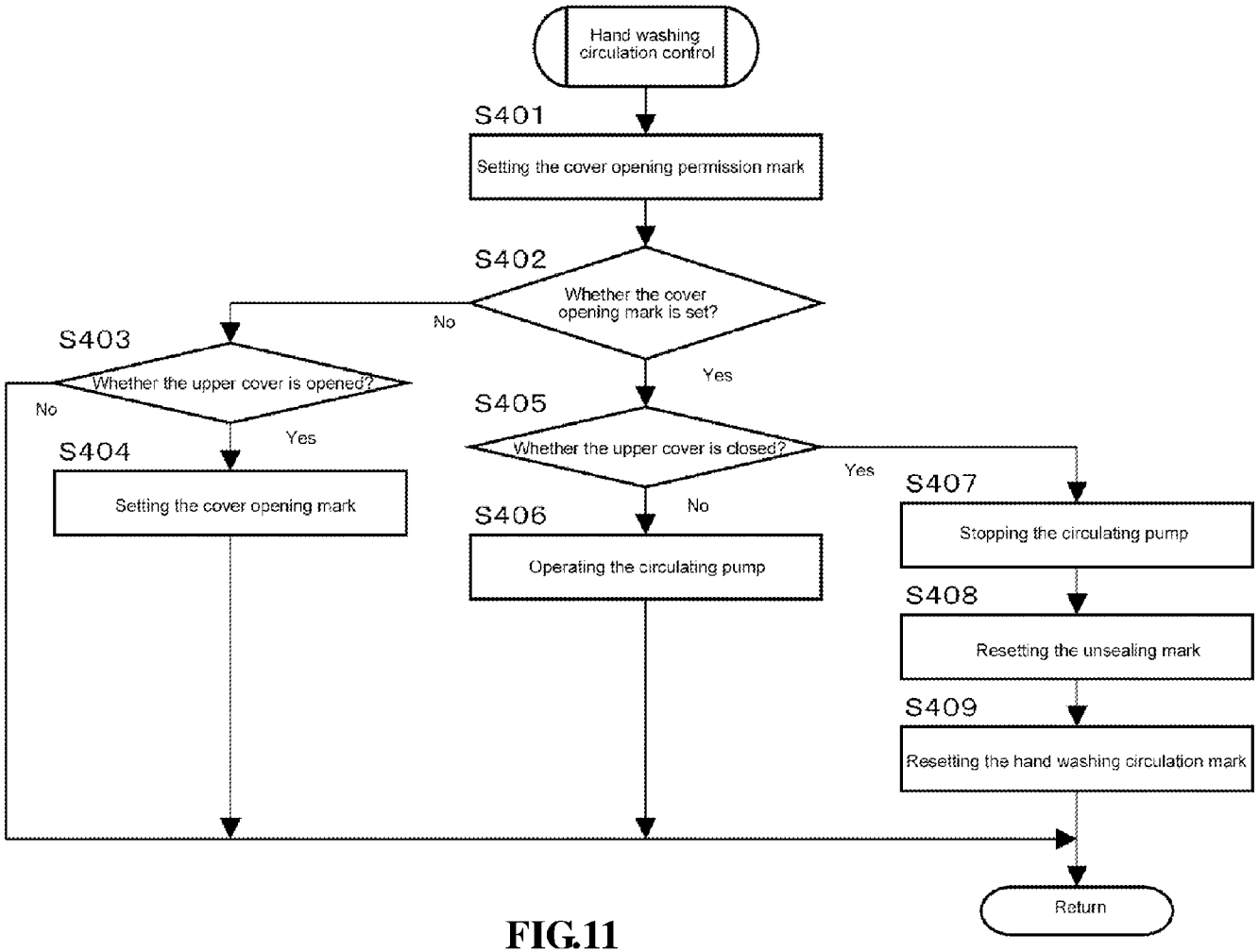
FIG. 11 is a flow chart showing a hand washing circulation control processing involved in embodiments.
Figure 12:
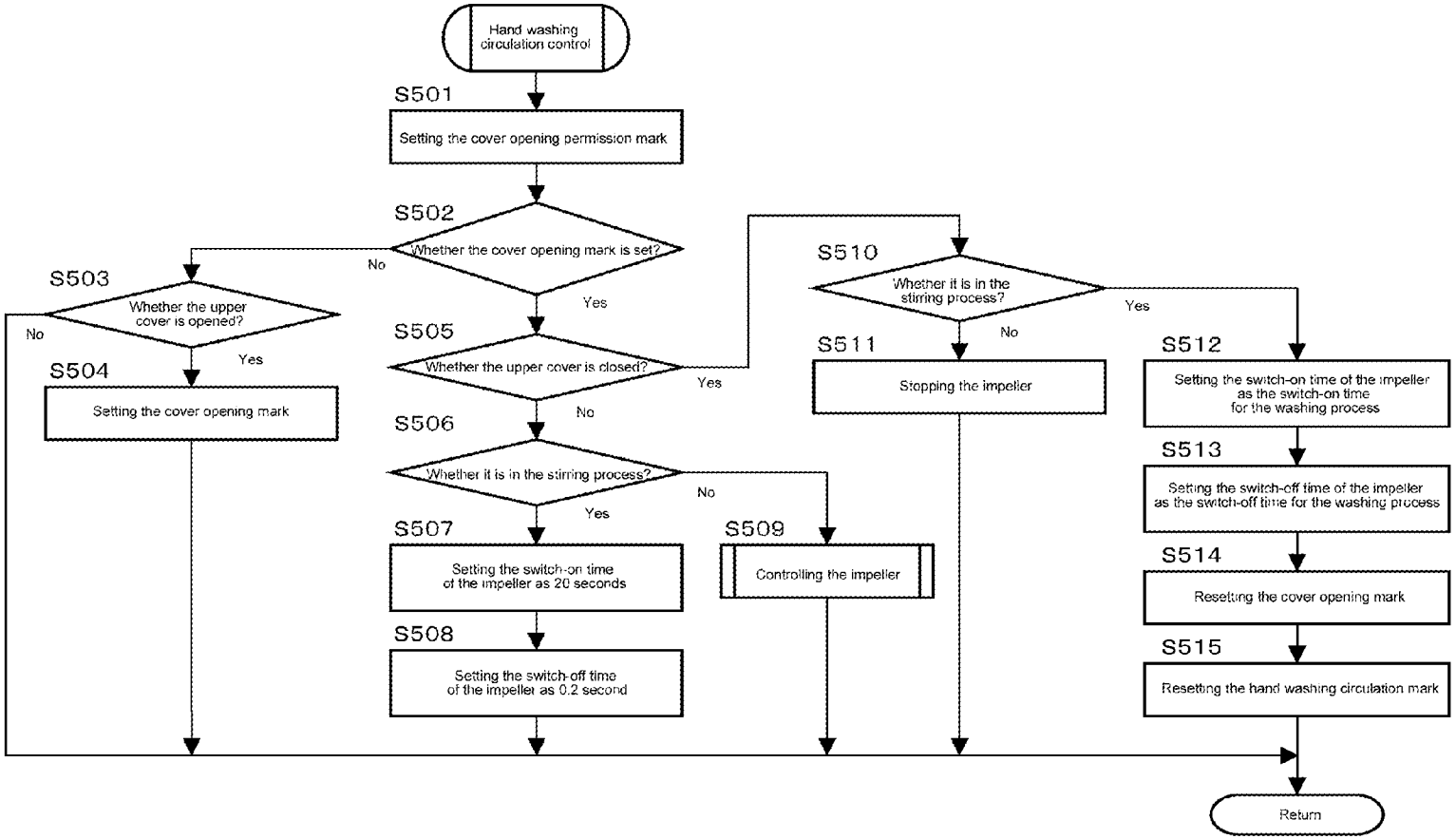
FIG. 12 is a flow chart showing a hand washing circulation control processing involved in changed embodiment 1.
Figure 13:
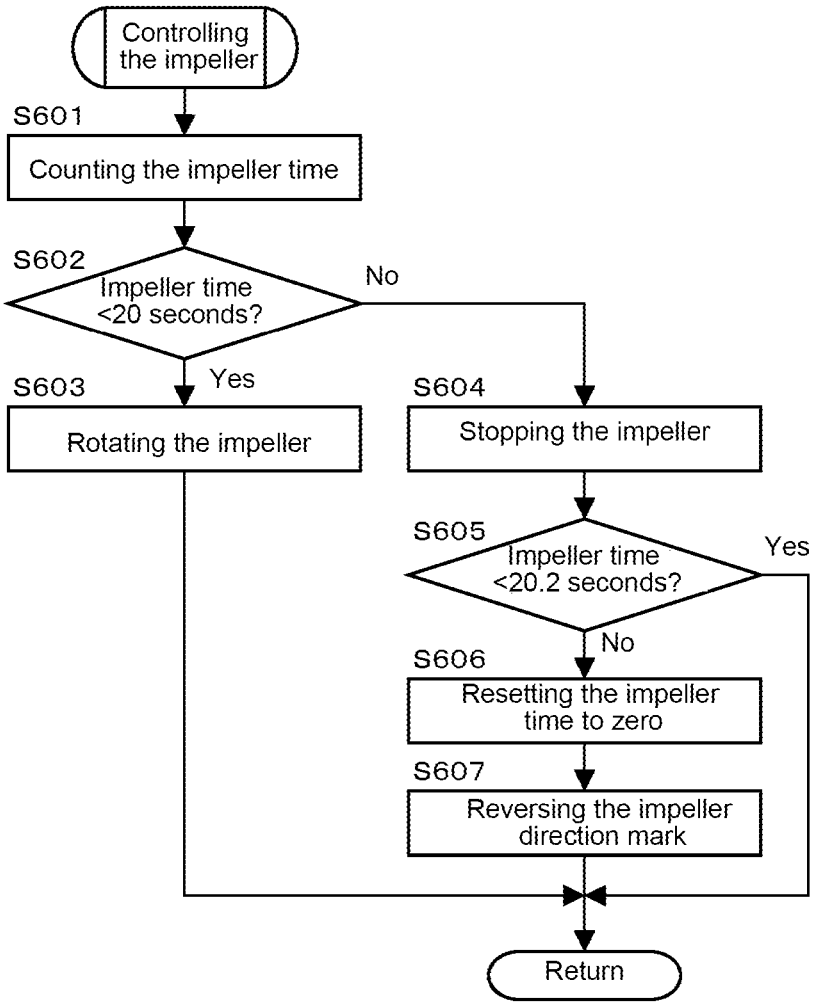
FIG. 13 is a flow chart showing an impeller control processing involved in changed embodiment 1.

FIG. 12 is a flow chart showing a hand washing circulation control processing involved in the present changed embodiment. FIG. 13 is a flow chart showing an impeller control processing contained in the hand washing circulation control processing of FIG. 12. In the present changed embodiment, in step S16 of the main routine of the hand washing control processing, the hand washing circulation control processing of FIG. 11 are replaced, and the hand washing circulation control processing of FIG. 12 is executed.

The control part 91 sets the cover opening permission mark (S501); and then, as long as the cover opening mark is not set (S502: No), the cover opening mark is set when the upper cover 15 is opened (S503: Yes->S504). As long as the cover opening mark is set (S502: Yes) and the upper cover 15 is not closed (S505: No), the control device 91 judges whether it is just in a duration of a stirring process in the washing process (S506).

Under a condition that it is just in the duration of the stirring process, the impeller 24 is already driven. Thus, under a condition that it is just in the duration of the stirring process (S506: Yes), the control part 91 sets switch-on time of the impeller 24 as switch-on time of 20 seconds for the hand washing circulation (S507) which is longer than switch-on time for the washing process, and sets switch-off time of the impeller 24 as switch-off time of 0.2 second for the hand washing circulation (S508). Thus, by pressing down the hand washing circulation button 83, the impeller 24 rotates in a left direction and a right direction in a state that a rotational time is longer than the time before the hand washing circulation operation is started by one period. Thus, compared to the time before the hand washing circulation operation is started, quantity of water discharged from the discharge port 26*a* of the circulating water path part 26 is increased. In addition, switch-on time of the impeller during the washing process is, for example, about 1.5 seconds, and switch-off time of the impeller during the washing process is, for example, about 0.5 second.

On the other hand, under a condition that it is just not in the duration of the stirring process (S506: No), the control part 91 executes an impeller control processing shown in FIG. 13 (S509). The control part 91 counts time (hereafter called "impeller time") for controlling the impeller 24 through a built-in timer (S601). Then the control part 91 judges whether the impeller time is shorter than switch-on time of 20 seconds for the hand washing circulation of the impeller 24 (S602). The control part 91 rotates the impeller 24 (S603) during a period that the impeller time is shorter than 20 seconds (S602: Yes), and stops the impeller 24 (S604) when the impeller time reaches 20 seconds (S602: No).

After the impeller 24 is stopped, the control part 91 judges whether the impeller time is shorter than time of 20.2 seconds obtained by adding switch-on time of 20 seconds for the hand washing circulation and switch-off time of 0.2 second for the hand washing circulation (S605). The control part 91 continues to count the impeller time and maintains the impeller 24 in a stopped state during a period that the impeller time is shorter than 20.2 seconds (S605: Yes). When the impeller time reaches 20.2 seconds (S605: No), the control part 91 resets the impeller time to zero (S606) to reverse an impeller direction mark (S607). The impeller direction mark is a control mark for determining a rotational direction of the impeller 24. Whenever the mark is reversed, the rotational direction of the impeller 24 is switched. By switching the impeller direction mark, next, the impeller 24 rotates towards a direction opposite to a previous direction when a processing of step S601 to step S603 is executed.

In this way, by executing the impeller control processing, similar to the condition of judging in step S506 that it is just in the duration of the stirring process, the impeller 24 rotates in a left direction and a right direction with a switch-on/switch-off period formed by switch-on time and switch-off time for the hand washing circulation. Thus, water greater than that in the washing process when the impeller 24 rotates is discharged from the discharge port 26*a* of the circulating water path part 26.

During a period that the impeller 24 rotates with the switch-on/switch-off period for the hand washing circulation, when the upper cover 15 is closed, the control part 91 judges in step S505 that the upper cover 15 is already closed (S505: Yes). As long as it is just not in the duration of the stirring process (S510: No), the control part 91 stops the impeller 24 (S511). On the other hand, as long as it is just in the duration of the stirring process (S510: Yes), the control part 91 sets switch-on time of the impeller 24 as switch-on time for the washing process (S512), and sets switch-off time of the impeller 24 as switch-off time for the washing process (S513). Thus, rotation of the impeller 24 returns to rotation of the switch-on/switch-off period in the washing process. The control part 91 resets the cover opening mark (S514) and resets the hand washing circulation mark (S515).

According to the present changed embodiment, similar to above embodiments, because water accumulated in the washing and dewatering tank 22 can be watered on washings for hand washing, the user can use water containing detergents in the washing process to perform hand washing of washings. In addition, during hand washing, because water accumulated in the washing and dewatering tank 22 is used for hand washing, hand washing can be performed while efficiently using water.

Moreover, according to the present changed embodiment, because water in the washing and dewatering tank 22 is circulated by using a pump mechanism of the impeller 24, a hand washing circulation operation can be performed without using the circulating pump unit 50.

Thus, according to the present changed embodiment, in the hand washing circulation operation, because the impeller 24 rotates for switch-on time longer than switch-on time in the washing process, quantity of water discharged from the circulating water path parts 26 can be increased and water can be adequately watered on washings for hand washing.

<Changed Embodiment 2>

In the above changed embodiment 1, to increase quantity of water discharged from the circulating water path parts 26, switch-on time of the impeller 24 is set to be longer than switch-on time for the washing process. However, like the present changed embodiment, to increase quantity of water discharged from the circulating water path parts 26, a rotational speed of the impeller 24 can also be higher than a rotational speed for the washing process.

Figure 14:
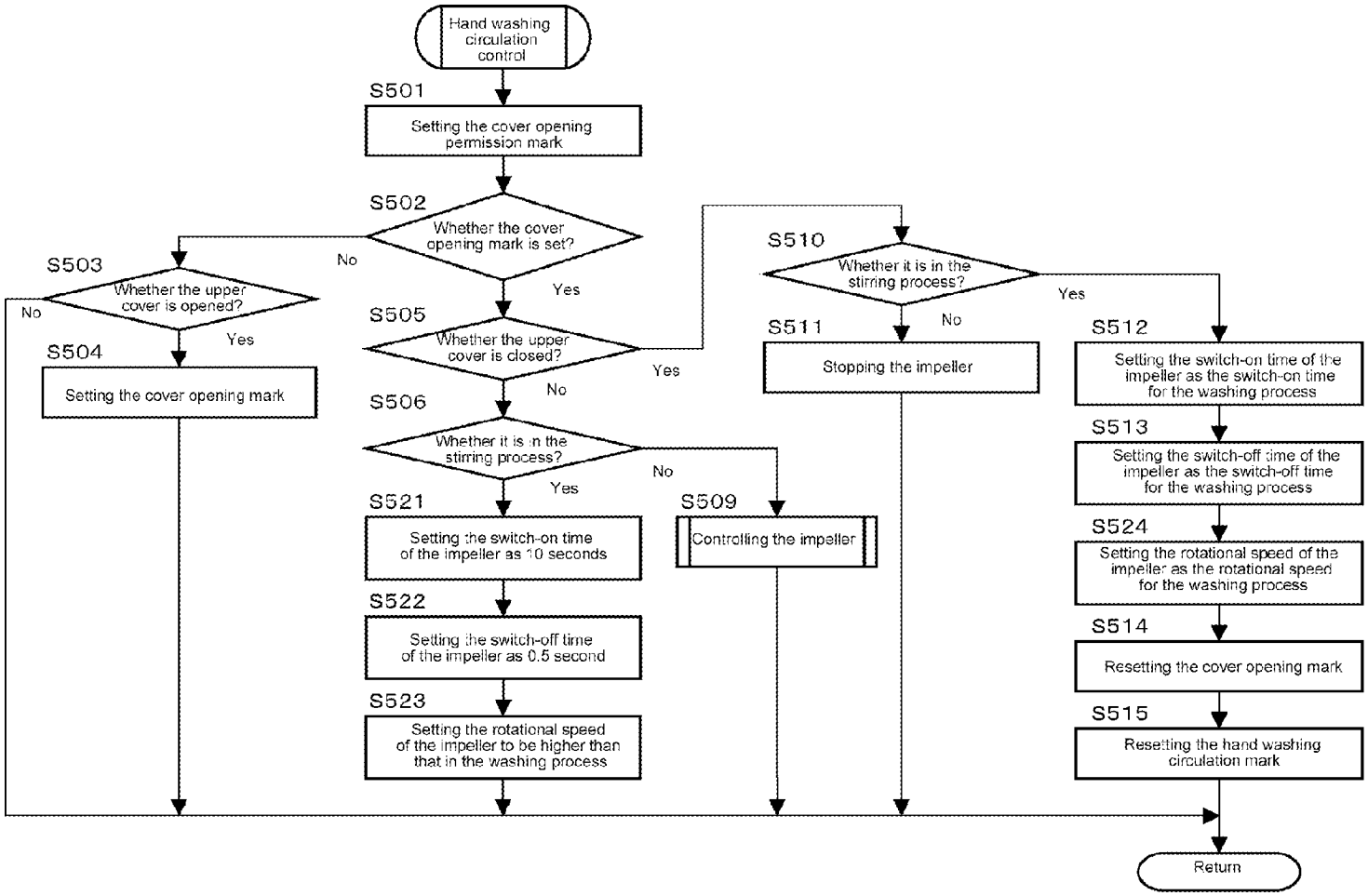
FIG. 14 is a flow chart showing a hand washing circulation control processing involved in changed embodiment 2.
Figure 15:
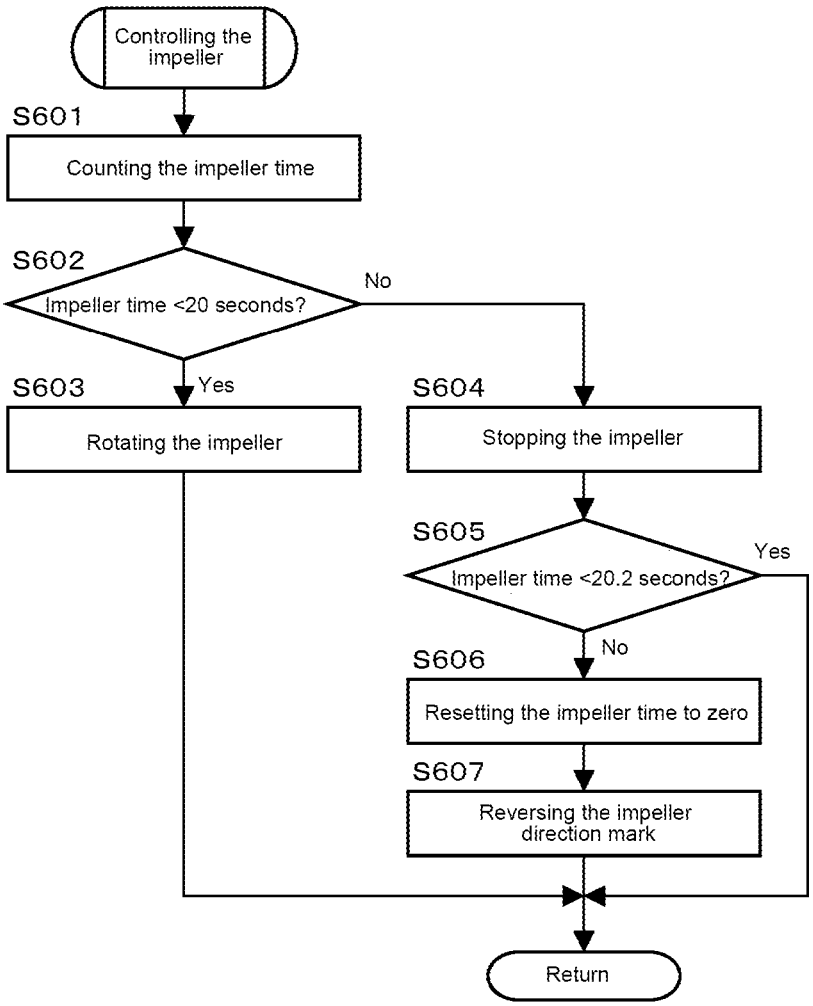
FIG. 15 is a flow chart showing an impeller control processing involved in changed embodiment 2.

FIG. 14 is a flow chart showing a hand washing circulation control processing involved in the present changed embodiment. FIG. 15 is a flow chart showing an impeller control processing contained in the hand washing circulation control processing of FIG. 14. In the flow chart of FIG. 14, a processing of step S507 and step S508 of the flow chart of FIG. 12 is replaced by a processing of step S521 to step S523, and a processing of step S524 is added to a back segment of a processing of step S514 of the flow chart of FIG. 12. In addition, in the flow chart of FIG. 15, a processing of step S602, step S603 and step S605 of the flow chart of FIG. 14 is replaced by a processing of step S611 to step S613. Processings different from the changed embodiment 1 are mainly described below.

In the hand washing circulation control processing of FIG. 14, when the control part 91 judges in step S506 that it is just in the duration of the stirring process (S506: Yes), switch-on time of the impeller 24 is set as switch-on time of 10 seconds for the hand washing circulation (S521) which is longer than switch-on time for the washing process, and switch-off time of the impeller 24 is set as switch-off time of 0.5 second for the hand washing circulation (S522). Then, the control part 91 sets a rotational speed of the impeller 24 as a rotational speed higher than that in the washing process (S523). By pressing down the hand washing circulation button 83, the impeller 24 rotates in a left direction and a right direction in a state that a rotational time is longer than the time before the hand washing circulation operation is started by one period and the rotational speed is higher. Thus, compared to the time before the hand washing circulation operation is started, quantity of water discharged from the discharge port 26*a* of the circulating water path part 26 is increased.

As long as it is just in the duration of the stirring process when the upper cover 15 is closed, the control part 91 further sets the rotational speed of the impeller 24 as the rotational speed for the washing process (S524) after setting switch-on time of the impeller 24 as switch-on time for the washing process (S512) and setting switch-off time of the impeller 24 as switch-off time for the washing process (S513).

Next, in the impeller control processing of FIG. 15, the control part 91 judges whether the impeller time is shorter than switch-on time of 10 seconds for the hand washing circulation (S611). The control part 91 rotates the impeller 24 at a rotational speed higher than that in the washing process (S612) during a period that the impeller time is shorter than 10 seconds (S611: Yes), and stops the impeller 24 (S604) when the impeller time reaches 10 seconds (S611: No).

After the impeller 24 is stopped, the control part 91 judges whether the impeller time is shorter than the time of 10.5 seconds obtained by adding switch-on time of 10 seconds for the hand washing circulation and switch-off time of 0.5 second for the hand washing circulation (S613). When the impeller time reaches 10.5 seconds (S613: No), the control part 91 resets the impeller time to zero (S606).

According to the present changed embodiment, in the hand washing circulation operation, because the impeller 24 rotates at the rotational speed higher than that in the washing process, quantity of water discharged from the circulating water path parts 26 is increased and water can be adequately watered on washings for hand washing.

Thus, according to the present changed embodiment, because the impeller 24 rotates for switch-on time longer than switch-on time in the washing process, quantity of water discharged from the circulating water path parts 26 is increased and water can be adequately watered on washings for hand washing.

In addition, in the present changed embodiment, the impeller 24 can also rotate for switch-on time as same as switch-on time in the washing process.

<Other Changed Embodiments>

In above embodiments, an upper surface of the auxiliary washing plate 100 forms concaves and convexes in a wave pattern by annular convex parts 103 arranged in a concentric shape. However, as long as the upper surface of the auxiliary washing plate 100 can obtain an effect that stains are washed out when washings are rubbed, any shape of concaves and convexes can also be formed. For example, by arranging a plurality of convex parts, which extend linearly in a single direction, in a direction perpendicular to the single direction, the concaves and convexes can also be formed on the upper surface of the auxiliary washing plate 100.

In addition, in above embodiments, the acceptable water level for a hand washing water supply judgment processing is set as a water level as high as possible at which water does not overflow from an overflow port due to water supply from the water supply unit 60 under a condition of performing standard time hand washing. However, the acceptable water level can also be set as a water level as high as possible at which a water surface does not exceed the upper surface of the auxiliary washing plate 100 installed in the washing and dewatering tank 22 under a condition of performing standard time hand washing. In this case, when the auxiliary washing plate 100 is configured to perform hand washing, washings can be prevented from being immersed in polluted water in the washing and dewatering tank 22.

Then, in above embodiments, water supply time is set as 30 seconds; and when the human body induction sensor 71 detects a part of the human body, set time is set as 25 seconds. However, these values are only examples and can be set as appropriate values. Although the set time is set as time below the water supply time when a part of the human body is detected, under a condition that the time is set to be equal to the water supply time, water supply from the water supply unit 60 is immediately stopped when no part of the human body is detected through the human body induction sensor 71.

Similarly, in the changed embodiment 1, switch-on time for the hand washing circulation is set as 20 seconds and switch-off time for the hand washing circulation is set as 0.2 second. Then, in the changed embodiment 2, switch-on time for the hand washing circulation is set as 10 seconds, and switch-off time for the hand washing circulation is set as 0.5 second. These values of switch-on time and switch-off time for the hand washing circulation can also be properly set. However, switch-on time for the hand washing circulation is made to be longer than switch-on time in the washing process.

Then, although the full-automatic washing machine 1 of above embodiments has no drying function, the present disclosure is also suitable for an full-automatic washing machine having a drying function.

In addition, various modifications can be properly made to embodiments of the present disclosure within a scope of a technical concept expressed within a scope of claims.

Reference Signs:

22 washing and dewatering tank;
24 impeller;
24*a* back leaf;
26 circulating water path part;
26*a* discharge port;
31 drive motor;
50 circulating pump unit (circulating water supply part and water supply part);
60 water supply unit (running water supply part and water supply part);
62 detergent housing part;
71 human body induction sensor;
82 hand washing water supply button (running water supply button and water supply button);
83 hand washing circulation button (circulating water supply button and water supply button); and
91 control part (water supply control part).

What is claimed is:

1. A washing machine, comprising:

a washing and dewatering tank for performing washing and dewatering of washings;

a water supply part for supplying water into the washing and dewatering tank;

a water supply control part for controlling the water supply part;

an auxiliary washing plate which is detachably installed in the washing and dewatering tank and has a shape of concaves and convexes on an upper surface;

a water supply button which is operated when the auxiliary washing plate installed in the washing and dewatering tank is configured to perform hand washing of washings; and a human body induction sensor on which a detecting surface faces inside of the washing and dewatering tank;

wherein the water supply control part supplies water to the water supply part based on a condition already operated on the water supply button, wherein the water supply part comprises a running water supply part which is connected with a water tap and makes running water supplied from the water tap to flow toward the auxiliary washing plate from an upper part of the auxiliary washing plate;

wherein the water supply button comprises a running water supply button configured to make the running water supply part to operate; and wherein the water supply control part stops water supply based on the running water supply part according to a condition that the human body induction sensor detects no more part of a human body after the running water supply part starts to supply water into the washing and dewatering tank.

2. The washing machine according to claim 1, wherein the water supply part comprises: a circulating water supply part configured to pump up water accumulated in the washing and dewatering tank and make the water flow toward the auxiliary washing plate from an upper part of the washing and dewatering tank; and the water supply button comprises: a circulating water supply button configured to make the circulating water supply part operate.

3. The washing machine according to claim 2, wherein the water supply control part does not supply water through the water supply part under a condition that the water supply button is operated in a process after the washing process.

4. The washing machine according to claim 2, further comprising:

an impeller configured in the washing and dewatering tank and configured to generate water flows through rotation; and a drive motor for driving the impeller;

wherein the circulating water supply part comprises: a back leaf formed on a back surface of the impeller; and a circulating water path part arranged on a circumference surface of the washing and dewatering tank and configured to make the pumped water flow toward the auxiliary washing plate from an upper discharge port through a water pumping function of the back leaf;

the water supply control part rotates the impeller through the drive motor in a mode that quantity of water which is based on an operation of the water supply button and is discharged from the discharge port is greater than water quantity discharged from the discharge port in a washing process.

5. The washing machine according to claim 4, wherein the water supply control part does not supply water through the water supply part under a condition that the water supply button is operated in a process after the washing process.

6. The washing machine according to claim 1, wherein the water supply control part does not supply water through the water supply part under a condition that the water supply button is operated in a process after the washing process.

7. A washing machine, comprising:

a washing and dewatering tank for performing washing and dewatering of washings;

a water supply part for supplying water into the washing and dewatering tank;

a water supply control part for controlling the water supply part;

an auxiliary washing plate which is detachably installed in the washing and dewatering tank and has a shape of concaves and convexes on an upper surface;

a water supply button which is operated when the auxiliary washing plate installed in the washing and dewatering tank is configured to perform hand washing of washings; and a human body induction sensor on which a detecting surface faces inside of the washing and dewatering tank;

wherein the water supply control part supplies water to the water supply part based on a condition already operated on the water supply button;

wherein the water supply part comprises a running water supply part which is connected with a water tap and makes running water supplied from the water tap to flow toward the auxiliary washing plate from an upper part of the auxiliary washing plate;

wherein the water supply button comprises a running water supply button configured to make the running water supply part to operate;

wherein the running water supply part comprises a detergent housing part through which running water flows, wherein detergents housed in the detergent housing part are mixed with running water and flow toward the auxiliary washing plate; and wherein the water supply control part stops water supply based on the running water supply part according to a condition that the human body induction sensor detects no more part of a human body after the running water supply part starts to supply water into the washing and dewatering tank.

8. The washing machine according to claim 7, wherein the water supply part comprises: a circulating water supply part configured to pump up water accumulated in the washing and dewatering tank and make the water flow toward the auxiliary washing plate from an upper part of the washing and dewatering tank; and the water supply button comprises: a circulating water supply button configured to make the circulating water supply part operate.

9. The washing machine according to claim 8, wherein the water supply control part does not supply water through the water supply part under a condition that the water supply button is operated in a process after the washing process.

10. The washing machine according to claim 8, further comprising:

an impeller configured in the washing and dewatering tank and configured to generate water flows through rotation; and a drive motor for driving the impeller;

wherein the circulating water supply part comprises: a back leaf formed on a back surface of the impeller; and a circulating water path part arranged on a circumference surface of the washing and dewatering tank and configured to make the pumped water flow toward the auxiliary washing plate from an upper discharge port through a water pumping function of the back leaf;

the water supply control part rotates the impeller through the drive motor in a mode that quantity of water which is based on an operation of the water supply button and is discharged from the discharge port is greater than water quantity discharged from the discharge port in a washing process.

11. The washing machine according to claim 10, wherein the water supply control part does not supply water through the water supply part under a condition that the water supply button is operated in a process after the washing process.

12. The washing machine according to claim 7, wherein the water supply control part does not supply water through the water supply part under a condition that the water supply button is operated in a process after the washing process.

* * * * *